US005556235A

United States Patent [19]

Morrison et al.

[11] Patent Number: 5,556,235

[45] Date of Patent: Sep. 17, 1996

[54] ROCK BOLTER

[75] Inventors: Ward D. Morrison, Claremont; Perry L. Coombs, both of Claremont, N.H.

[73] Assignee: Cannon Industries, Inc., Claremont, N.H.

[21] Appl. No.: 390,746

[22] Filed: Feb. 17, 1995

Related U.S. Application Data

[63] Continuation-in-part of Ser. No. 140,299, Oct. 20, 1993, abandoned.

[30] Foreign Application Priority Data

Oct. 19, 1994 [CA] Canada ..... 2118447

[51] Int. Cl.[6] ..... E21D 20/00

[52] U.S. Cl. ..... 405/303; 81/55; 227/119; 269/34; 269/234

[58] Field of Search ..... 81/55, 57.25, 57.41; 166/77, 85; 173/42, 184, 190; 175/135, 162, 203, 220; 227/119; 269/34, 136, 234; 405/303

[56] References Cited

U.S. PATENT DOCUMENTS

| | | | |
|---|---|---|---|
| 2,341,602 | 2/1944 | Dewey | 269/34 X |
| 2,850,926 | 9/1958 | Jobe | 269/34 X |
| 3,218,893 | 11/1965 | Madison et al. | 81/55 |
| 3,330,021 | 7/1967 | Jacobsen | 269/34 X |
| 3,441,323 | 4/1969 | Vincent et al. | 269/34 X |
| 3,580,459 | 5/1971 | Gage et al. | 269/34 X |
| 4,158,520 | 6/1979 | Prebensen . | |
| 4,215,953 | 8/1980 | Perraud | 405/303 |
| 4,226,559 | 10/1980 | Prebensen | 405/303 |
| 4,351,625 | 9/1982 | Selestam et al. | 405/303 |
| 4,398,850 | 8/1983 | Talvensaari | 405/303 X |
| 4,420,277 | 12/1983 | Hibbard et al. . | |
| 4,438,984 | 3/1984 | Leppala | 269/34 X |
| 4,473,325 | 9/1984 | Beney et al. | 405/303 |
| 4,497,378 | 2/1985 | Beney et al. | 173/32 |
| 4,706,948 | 11/1987 | Kroecher | 269/34 |
| 4,972,911 | 11/1990 | Rajakallio | 175/220 |
| 5,114,279 | 5/1992 | Bjerngren et al. | 405/303 |

OTHER PUBLICATIONS

Eimco–Secoma TUI 2 HD Roof Bolting Turret brochure (1983).

*Primary Examiner*—John A. Ricci
*Attorney, Agent, or Firm*—Michael J. Weins

[57] ABSTRACT

The present invention relates to a device for setting rock bolts. The device employs a common element for affixing the end of a feed shell with respect to a rock surface, stabilizing the feed shell and providing a common centralizer for centering all subsequent bolt setting operations. The device also has a bolt magazine which stores, advances and positions the bolts in line with a bolt driver.

16 Claims, 20 Drawing Sheets

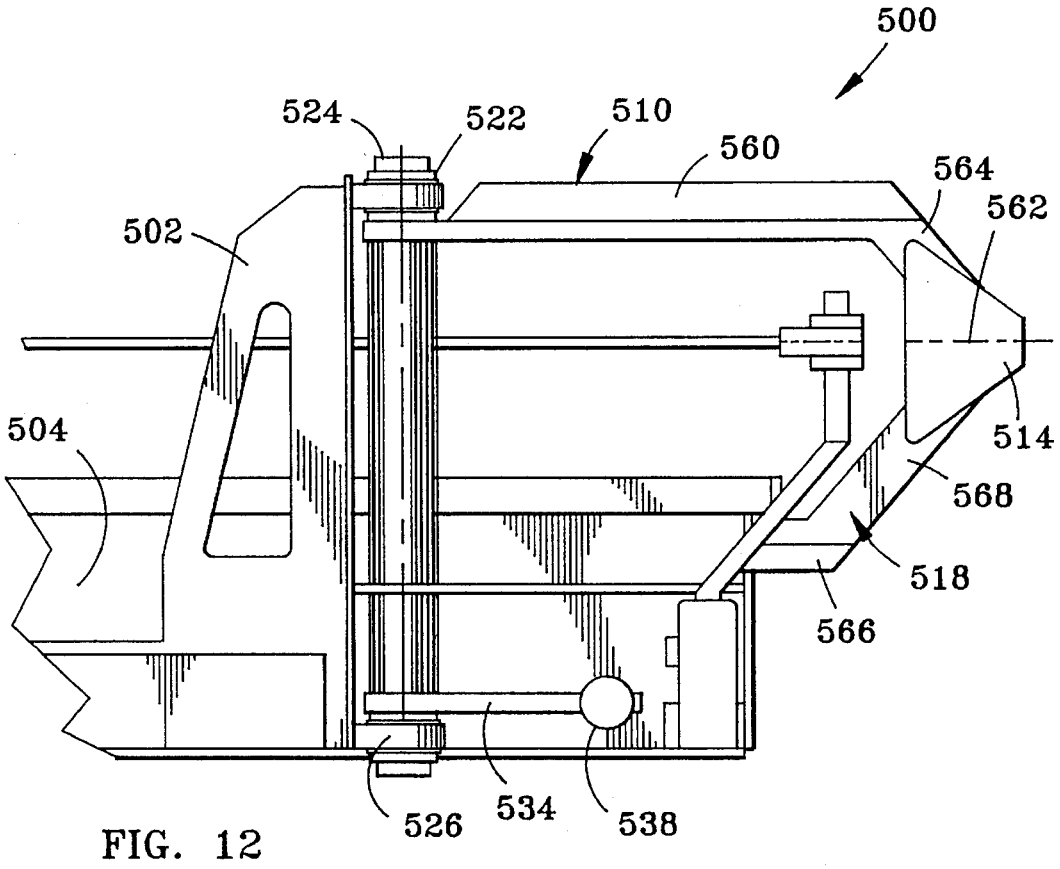
FIG. 12
FIG. 13
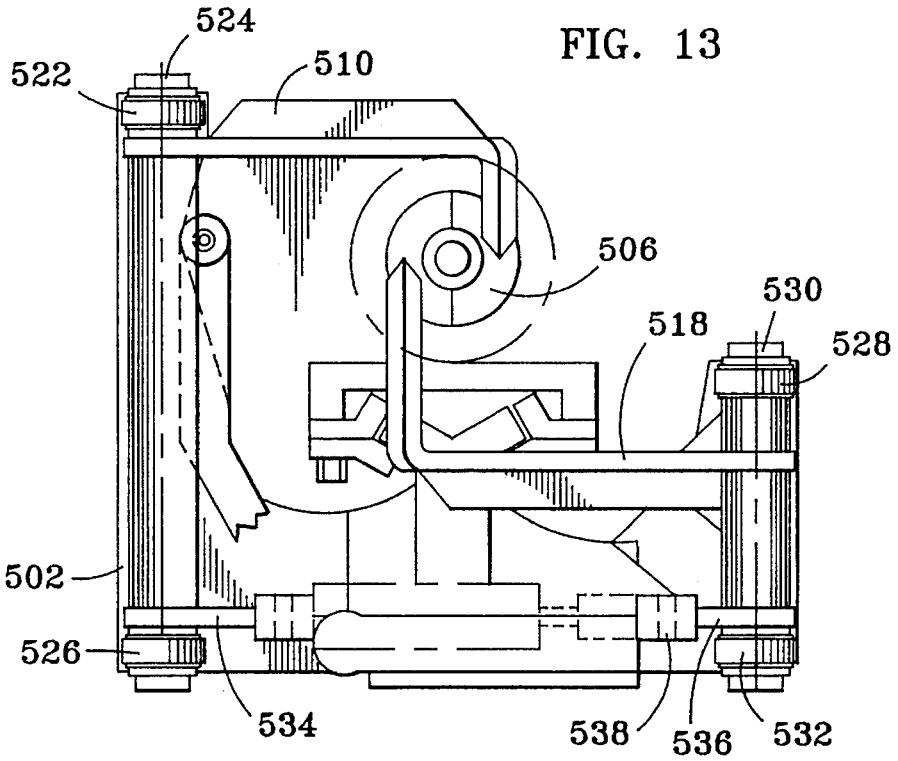

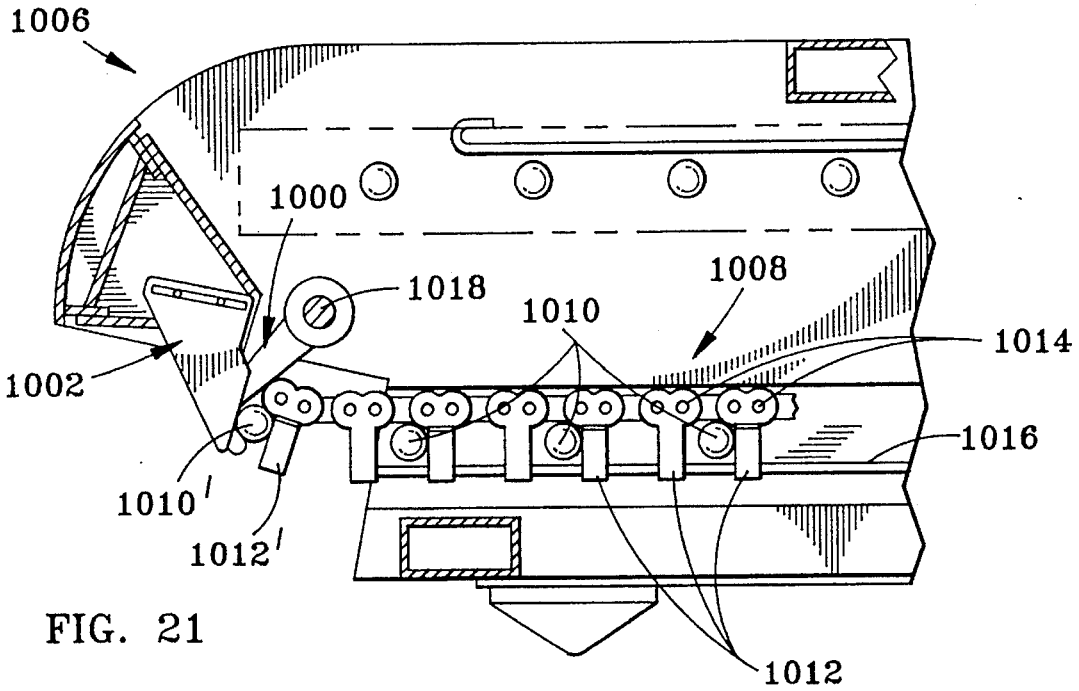
FIG. 21
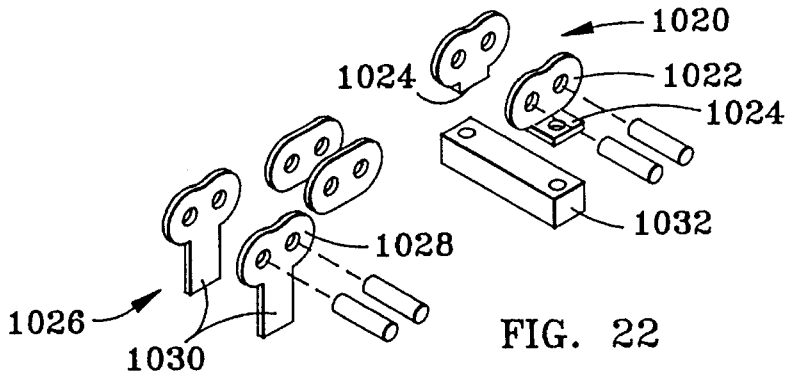
FIG. 22
FIG. 23
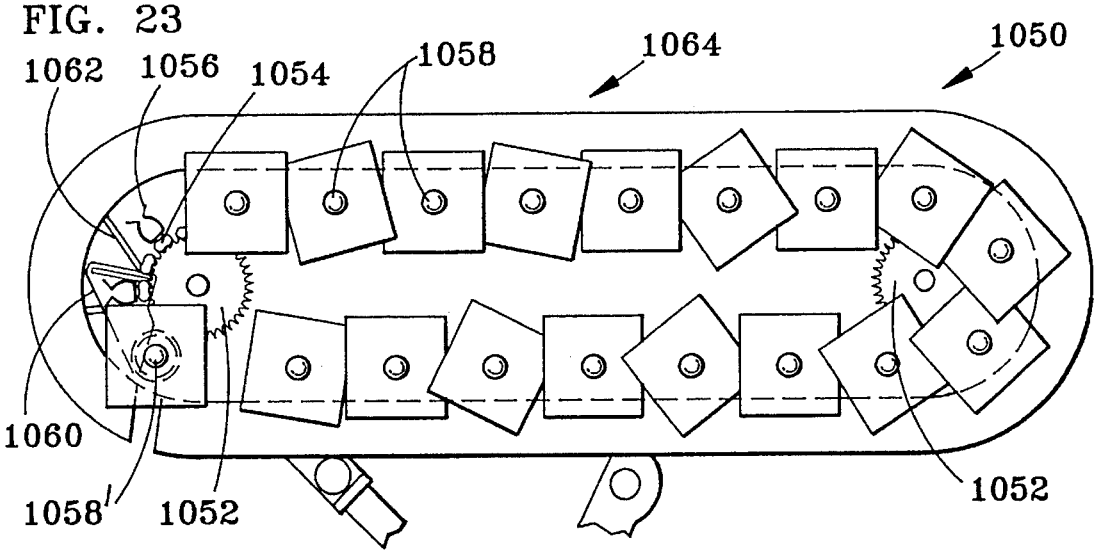

ROCK BOLTER

This is a continuation-in-part of application Ser. No. 08/140,299 filed on Oct. 20, 1993 now abandoned.

FIELD OF INVENTION

The present invention relates to a rock bolter and, more particularly, to a rock bolter having the following: a single centralizer for all drilling and bolting operations which also serves as a stabilizer for a feed shell and a bolt delivery system which indexes bolts and positions them in line with a bolt driver.

BACKGROUND OF THE INVENTION

A variety of rock bolters have been developed which employ a common feed shell. U.S. Pat. Nos. 4,158,520, 4,226,559, and 5,114,279 teach the use of a common feed shell. However, none of these patents employ a single element for stabilizing the feed shell which also serves as both a centralizer for a drill steel and a centralizer for other operations associated with bolt setting.

U.S. Pat. No. 4,226,559 also teaches a cylindrical bolt magazine where the bolts traverse a path such that the bolts can be tangentially removed from the magazine. While such design simplifies bolt setting, the cylindrical shape limits the number of bolts that can be practically employed.

Thus, there is a need for a rock bolter that will better facilitate maintaining alignment between the bolt hole and the bolt to be placed therein and provide a simplified bolt delivery system with greater bolt capacity.

OBJECTS OF THE INVENTION

It is an object of the invention to provide a rock bolter which employs a common centralizer for all operations associated with drilling, placing, and securing rock bolts.

It is another object of the invention to provide a centralizer which engages the rock surface.

It is a further object of the invention to provide a compliant surface for the rock engaging element of the centralizer.

Still another object of the invention is to provide a centralizer which will serve as a feed shell stabilizer, bracing the feed shell against the rock surface to be drilled.

Yet another object of the invention is to provide a split centralizer which can be opened to provide passage of a bolt plate therethrough.

Still a further object of the invention is to provide a split centralizer which opens into two sections which part from the rock surface before there is substantial separation between the two centralizer sections.

It is another object of the invention to provide a multiple bolt magazine.

It is yet another object of the invention to provide a bolt indexing magazine which aligns the bolts with a bolt driver and bolt hole.

It is yet a further object of the invention to provide a bolt magazine which also serves as a bolt plate magazine.

It is a further object of the invention to provide a bolt magazine which can be maintained at a substantial distance from the rock into which the bolt is to be driven.

It is a further object of the invention to provide a debris shield for the bolt magazine for use in rock bolting applications.

It is another object of the invention to provide a drill transfer system having a drill steel guide which moves away from the rock surface when the drill is placed in a park position.

It is another object of the invention to provide a drill transfer system where a stop is provided to avoid interference between the bolt magazine and the bolt driver.

These and other objects of the present invention will become apparent from the following description, claims and drawings.

SUMMARY OF THE INVENTION

The present invention is for a rock bolter and is directed to two elements of the bolter: a stinger/centralizer and a bolt transport system providing a multi-functional bolt magazine.

The term stinger, as used herein, is defined as a support attached to a feed shell, having a feed shell axis, of a rock bolter which engages the rock surface into which bolts are embedded. The stinger provides support to the feed shell and maintains it in a defined position. The term centralizer as used herein is defined as an element through which a drill steel passes; equipment for subsequent operations either pass into or through the centralizer during these operations. Centralizers are positioned near the rock surface and direct the drill steel and other related equipment into the rock surface. The present invention integrates the stinger and the centralizer into a single unit forming a stinger/centralizer.

The present invention, by integrating the improved stinger/centralizer with the bolt delivery system, provides a rock bolter with reduced complexity and improved efficiency. While it is preferred that these improvements are employed in combination to maximize their cooperative nature, the improvements will have utility when employed independently.

The stinger/centralizer of the present invention provides two functions associated with the bolting operation, a support for fixing the position of the feed shell and a guide to centralize the position of the drill steel, the bolt and other bolt setting apparatus so that all are directed to the same location.

During the drilling operation, rock engaging surfaces of the stinger/centralizer serve to provide additional support for the feed shell and to maintain its position with respect to the rock surface. A passage is provided through the stinger/centralizer. This passage guides the drill steel in a path substantially in line with the advancing drill. While drilling, this passage serves as the drill steel centralizer. After the drilling operation, the passage in the stinger/centralizer continues to serve as the centralizer for all subsequent drilling and bolt setting operations. Since the stinger/centralizer maintains contact with the rock being drilled, the position of the hole in the rock is known with certainty.

Since the stinger/centralizer is used for bolt setting, it is split, allowing the stinger/centralizer to open and a bolt plate, a bolt head and a bolt driver to pass through the centralizer during the bolt setting operation.

The stinger/centralizer, in its simplest form, has a stinger base which attaches to the rock bolter. When a rock bolter having a single feed shell is employed, it is preferred that the base of the stinger/centralizer be attached to the feed shell of the rock bolter. This stinger base can form part of a transfer plate on which are mounted the additional elements employed in the rock bolting process.

In the stinger/centralizer, a first head element is provided which has a first rock engaging surface and a first head cavity having a first cavity wall which intersects the first rock engaging surface. A first head arm attaches to the first head element and movably attaches to the stinger base.

A second head element is provided which has a second rock engaging surface. The second head element also has a second head cavity having a second cavity wall which intersects the second rock engaging surface. A second head arm attaches to the second head element and movably attaches to the stinger base.

It is further preferred that the first rock engaging surface be the principal rock engaging surface. Means are provided for engaging the first head element with the second head element such that the first head cavity and the second head cavity provide a centralizer passage which is substantially parallel to the drill path.

Preferably, the first head arm attaches to the stinger base with a first bracket while the second head arm attaches to the stinger base with a second bracket. These brackets can be either an integral part of the stinger base or an attachment to the stinger base. In one preferred embodiment, the first head arm slidably engages the first bracket and the second head arm slidably engages the second bracket.

In this embodiment, where the head arms slidably engage the brackets, the sliding action of the arms in the brackets serves to engage the first head element with the second head element and the sliding action is regulated to assure that the first head cavity and the second head cavity meet to form the centralizer passage having a head axis therethrough, the head axis being substantially parallel to the drill path. The sliding action is induced by means for translating the first head arm with respect to the second head arm. In one preferred embodiment, this means for translating is a linear actuator such as a pneumatic cylinder, which is attached to the first head arm and the second head arm.

It is further preferred that the first bracket and the second bracket be so positioned with respect to the stinger base that when the first head arm and the second head arm slide in the first bracket and the second bracket respectively, a component of the sliding motion is parallel to the feed shell axis. This will move the head arms away from the rock as the head elements separate.

To assure registry of the two head elements, it is further preferred that means be included for indexing the first head element with respect to the second head element and that a first retractable connector be used to slide the first head arm into the first bracket and that a second retractable connector be used to slide the second head arm into the second bracket. It is further preferred that these retractable connectors be linear actuators such as hydraulic cylinders.

It is further preferred that means are provided for advancing the first head element prior to the advancement of the second head element with the first head element reaching its full extension, prior to the second head element being brought into contact with the first head element. A means is provided to advance the rock engaging surfaces of the first head element and the second head element into contact with the rock surface after the head elements have been brought into contact with one another.

It is further preferred that the rock engaging surface of the first head element is fitted with a rock engaging surface extender, which is fabricated from a compliant material such as an elastomer with a high coefficient of friction such as rubber or urethane. Such material provides better contact between the head element and uneven rock surfaces and increases the coefficient of friction between the rock and the head element. The rock engaging surface extender by providing increased contact of the head element with the rock surface increases the support provided by the head element and enhances the stabilizing effect of the stinger/centralizer. The second head element is extended to engage with the first head element to form the centralizer. The second head element may also engage the rock owing to the irregularity of the rock surface and when doing so, offers support for the stinger/centralizer.

It is preferred that the first head element is mounted in a fixed position on the first head arm which in turn is slidably engaged in the first bracket. It is further preferred that to facilitate adjustment between the first head element and the second head element that a flexible joint be incorporated between the second head element and the second head arm. The second head element is pivotably mounted on the second head arm which, in turn, is slidably engaged in the second bracket.

Alternatively, if a device is employed where both the first head element and the second head element are mounted with flexible joints, one of the flexible joints can be disabled to assure that the centralizer passage remain aligned to direct the travel of the drill.

It is yet further preferred that head elements have mating surfaces which meet defining a plane containing the head axis of the stinger/centralizer and it is still further preferred that this plane be positioned nearly perpendicular to a projection of the second head arm on a plane normal to the head axis. Such a configuration of the head elements facilitates the positioning of the second head element relative to the fixed first head element.

In an alternative series of embodiments, the first head arm and the second head arm are also connected to the stinger base with brackets. However, in these embodiments, the first head arm and the second head arm are pivotably connected to the first bracket and the second bracket. The pivoting action of the arms about the brackets brings the first head element and the second head element into and out of engagement. This pivoting action provides a means for engaging the first head element and the second head element.

It is further preferred that when the head arms pivot with respect to the brackets, the pivoting action be brought about by providing a first pivot post which rotatably engages the first bracket. The first head arm is in turn attached to the first pivot post. Similarly, a second pivot post is provided which rotatably engages the second bracket. The second head arm is in turn attached to the second pivot post. With this configuration, rotation of the posts provides the pivoting action.

It is still further preferred that the first pivot post be provided with a first torque arm and that the second pivot post be provided with a second torque arm. In this embodiment, the means for rotating the first head arm with respect to the second head arm is provided by linear actuators such as pneumatic cylinders.

For uneven surfaces, opening of the centralizer may be impaired by the surface. To overcome this impairment and allow the centralizer to open permitting the bolt plate to pass therethrough, it is preferred that the centralizer have one component of its motion be away from the rock surface into which bolts are being set.

For embodiments of the stinger/centralizers which employ head arms that slidably engage the base and move in a plane parallel to the rock surface to open and close the head elements, opening of the head elements can be facilitated by first retracting the stinger/centralizer from the rock surface and then sliding the head arms to separate the head elements to provide for passage of the bolt plate. As discussed earlier, when the sliding action results in a component of the relative motion being parallel to the feed shell axis, the head elements, in addition to separating, will be withdrawn from the rock surface. This motion away from the rock will facilitate the opening of the head elements even if the surface is irregular.

When pivoting head arms are employed, the motion of the rock engaging surfaces of the head elements may be provided with a component of motion of the heads which is away from the rock surface. This motion can be provided by connecting the head arms to the head elements and the base plate such that when the head elements are engaged, the head arms will, when projected onto each other, cross.

To further facilitate the opening of the head elements, it is also preferred that the first head arm have a first base arm segment which is spaced apart from a central axis of the centralizer passage. The first base arm segment attaches to the base plate. A first head element arm segment of the first head arm attaches to the first base arm segment and is inclined with respect to the central axis by an angle of θ, where θ is about 45°. Similarly, the second head arm has a second base arm segment which is spaced apart from the central axis of the centralizer passage and attaches to the base plate. A second head element arm segment attaches to the second base arm segment and is inclined with respect to the central axis by an angle θ, where θ is about 45°.

The spaced apart base head arm segments permit the drill and bolt driver to advance therebetween, while the inclined head elements minimize the probability of contact with irregularities in the rock surface.

In the embodiment where slidably engaged arms are employed, by maintaining the head arms as elements of a conical surface having an apex angle of about 45° again reduces the probability of contact with projections and depressions in the surface.

The bolt delivery system of the present invention has particular utility when used in combination with the above described stinger/centralizer. However, it can also be used with other rock bolters not employing the stinger/centralizer of the present invention. The bolt delivery system of the present invention is designed to align bolts with the bolt driver and the centralizer which directs the bolts into a bore hole.

The bolt delivery system, in its simplest form, has a bolt magazine with advancable peripheral surfaces. A shaft having a first wheel and a second wheel mounted thereon offers a simple magazine. Each of these wheels have rims which serve as the advancable peripheral surfaces of the magazine. The bolt magazine is supported by a magazine holder. A magazine base is provided which is fixed with respect to the feed shell. The bolt magazine holder is pivotably mounted on the magazine base such that when a bolt is withdrawn from the bolt magazine, it is withdrawn substantially normal to the advancable peripheral surfaces of the bolt magazine.

In a preferred embodiment, the bolt magazine has an oval cross section and a magazine frame having a bolt entry region and a bolt exit region. The bolt magazine has a first frame end where the bolt entry region of the frame initiates and a second frame end where the bolt exit region of the frame terminates. The bolt magazine has a first bolt retaining shaft which is rotatably mounted to the magazine frame and a second bolt retaining shaft which is spaced apart from the first bolt retaining shaft and is also rotatably mounted to the magazine frame. A first pulley/sprocket is mounted on the first bolt retaining shaft while a second pulley/sprocket is mounted on the second bolt retaining shaft. A first belt/chain engages the first pulley/sprocket and the second pulley/sprocket. The terms pulley/sprocket and belt/chain will be defined as follows: pulleys will include the use of pulleys or wheels on which cables and belts can be engaged while sprockets will include gears and sprockets that will engage chains and belts. The belt/chain will include belts, both solid and woven as well as cables and chains. A third pulley/sprocket is mounted on the first bolt retaining shaft and is spaced apart from the first pulley/sprocket. A fourth pulley/sprocket is mounted one the second bolt retaining shaft and is spaced apart from the second pulley/sprocket. A second belt/chain is engaged to the third pulley/sprocket and the fourth pulley/sprocket. The pulley/sprockets are so positioned that the first belt/chain is parallel to the second belt/chain. In this embodiment, the belt/chains provide the advancable peripheral surfaces.

Bolt mounts are provided in pairs for fastening the bolts to the belt/chains. Paired bolt mounts are provided along the belt/chains. Bolt clips are suitable for holding bolts in position on the belt/chains; however, it is preferred that the bolts be mounted with fingers that extend out from the belt/chains. When fingers are used, one or more bolt retaining bars are provided to maintain the bolts between the fingers. The bolt retaining bars are maintained substantially parallel to the belt/chains with the spacing therebetween less than the finger length. Bolt retaining bar exit openings for the retaining bars are provided to facilitate the removal of a bolt from the belt. When multiple retaining bars are used, it is preferred that one of the bolt retaining bars be located in the bolt entry region of the magazine frame to contain the head region of the bolts while the second bolt retaining bar be located in the bolt exit region of the magazine frame to contain the tip region of the bolts. In cases where head region and tip region bolt retaining bars are employed, openings for the extraction of bolts from the fingers are provided. There is also an open region in head region bolt retaining bar to facilitate the insertion of bolts.

For magazines using fingers, one or more followers, which can be pivotably mounted on the first bolt retaining shaft, are provided; the first bolt retaining shaft being the shaft closest to the exit position of the bolts. If one follower is employed, it should be centrally located. The followers engage the bolts as the bolts advance into the open regions in the bolt retaining bars provided to extract the bolts. A single retaining bar centrally located with respect to the bolts can be employed; however, multiple retaining bars can be used. The followers are biased and designed to engage the bolt while the bolt is still engaged with the bolt retaining bars.

When a hydraulic motor is used to advance the bolts, bolt stops are provided which stop the bolt when the bolt is positioned for engagement with the bolt driver. If an indexing motor is employed to advance the bolts, the stops are not necessary.

It is further preferred that the bolt magazine also serve as a bolt plate magazine and provide a bolt/bolt plate magazine. When the bolt magazine serves as a bolt/bolt plate magazine (referred to as a bolt & plate magazine), the bolts are passed through bolt holes in the plates and the plates ride on the bolts. To stabilize the bolt plates as they ride on the bolts, a bolt plate channel is incorporated into the magazine frame and positioned in the bolt exit region of the magazine frame. The bolt plate channel has an inner guide wall and an outer guide wall with the outer guide wall being in close proximity to the second frame end. The bolt plate channel provides a guide path for the bolt plates and attaches to the frame of the bolt magazine. It is further preferred that the bolt plate channel engage the bolt plates such that bolts are internal to the bolt plate channel and that the guide path be so positioned to serve as a bolt tip retainer. A bolt plate opening of sufficient size to pass a bolt plate therethrough is provided in the bolt plate channel for unloading the bolts with the bolt plates thereon.

A bolt head rub-rail is preferably included in the bolt magazine. The bolt head rub-rail is attached to the head region of the magazine frame and is utilized to engage the back of the bolt heads. The rub-rail is configured to trace out a path following the path of the bolts as they are advanced by the belt/chain. The rub-rail preferably has a component of its path that is parallel to the feed shell axis so as to advance the bolts toward the exit region of the frame as the bolts move through the magazine and into the exit opening.

If the rock bolter is to be employed for setting bolts in roofs of underground mines, it is preferred that a magazine cap be provided to cover the bolt exit region of the frame. The magazine cap is solid except for a bolt extension port allowing the bolts to extend beyond the cap as they are advanced to the position where they align with the bolt driver and the centralizer. The magazine cap also preferably has a retainer section, the cross section of which has a sidewall that is parallel to the belt/chain and separated from the belt/chain by a distance of less than the finger length. The magazine cap can also increase the rigidity of the frame. Additional skin can be provided to increase the rigidity of the bolt magazine.

In a preferred embodiment, the bolt retaining shafts are rotatably engaged to the first frame end of the magazine and extend through an open central region of the second frame end of the magazine to rotatably engage the magazine cap which attaches to the second frame end. It is further preferred that the third pulley/sprocket and the fourth pulley/sprocket be mounted on the bolt retaining shafts near the point of engagement of the bolt retaining shafts to the magazine cap. This embodiment serves to position the pulley/sprockets toward the ends of the bolt retaining shafts and thus decreases the bending moment when a bolt stop is affixed to the cap.

It is also preferred that an inner bolt plate guide having a platform with a platform surface be provided which, together with the bolt plate channel, provides additional support for the exposed portion of the bolt plates when the bolt/bolt plate magazine is in position for drilling and inserting roof bolts. The inner bolt plate guide is positioned in the open central region of the second frame end of the magazine such that the platform surface of the inner bolt plate guide is substantially coplanar with the inner guide wall of the bolt plate channel.

To facilitate assembly of the magazine, it is preferred that the inner bolt plate guide have a modular platform with a central platform having a central platform surface and a disk shaped platform surface. The central platform resides between the first bolt retaining shaft and the second bolt retaining shaft. The central platform is contoured to meet with the disk platform. The disk platform is mounted on the second bolt retaining shaft. The central platform is affixed to the magazine cap.

When the bolt retaining shafts extend from the first frame end to the magazine cap, it is preferred that three bolt stops be provided to distribute the load on the bolt. These stops are preferably distributed as follows: one adjacent to the first pulley/sprocket, one adjacent to the first shaft-mounted bolt plate guide and one mounted adjacent to the end of a bolt exit port on the magazine cap.

A rear plate can also be provided to the bolt entry region of the frame. When the magazine cap and the rear plate extend beyond the bolts, it is necessary that there be passages provided in the magazine cap to allow removal of the bolts and, in the rear plate, to allow the bolts to be engaged by the driver. These passages must at a minimum form a path that will allow the bolt to be withdrawn from the magazine. In a preferred embodiment, the passage will allow the bolt driver to enter the magazine frame.

BRIEF DESCRIPTION OF THE DRAWINGS

FIG. 12 is a side view of another embodiment of the stinger/centralizer of the present invention. In this embodiment, arms are employed which rotate to bring the heads together.

FIG. 13 is a front view of the stinger/centralizer of FIG. 12.

FIG. 21 is a side cross sectional view of a region of a bolt magazine similar to the embodiment of FIG. 17. This embodiment uses chains with fingers to advance the bolts.

FIG. 22 is an exploded isometric view of a pair of links of the chain of FIG. 21.

FIG. 23 is a side cross sectional view of a bolt magazine which employs chains having clips to advance the bolts. The magazine is similar to the embodiment illustrated in FIG. 18.

BEST MODE OF CARRYING THE INVENTION INTO PRACTICE

Figure 1:
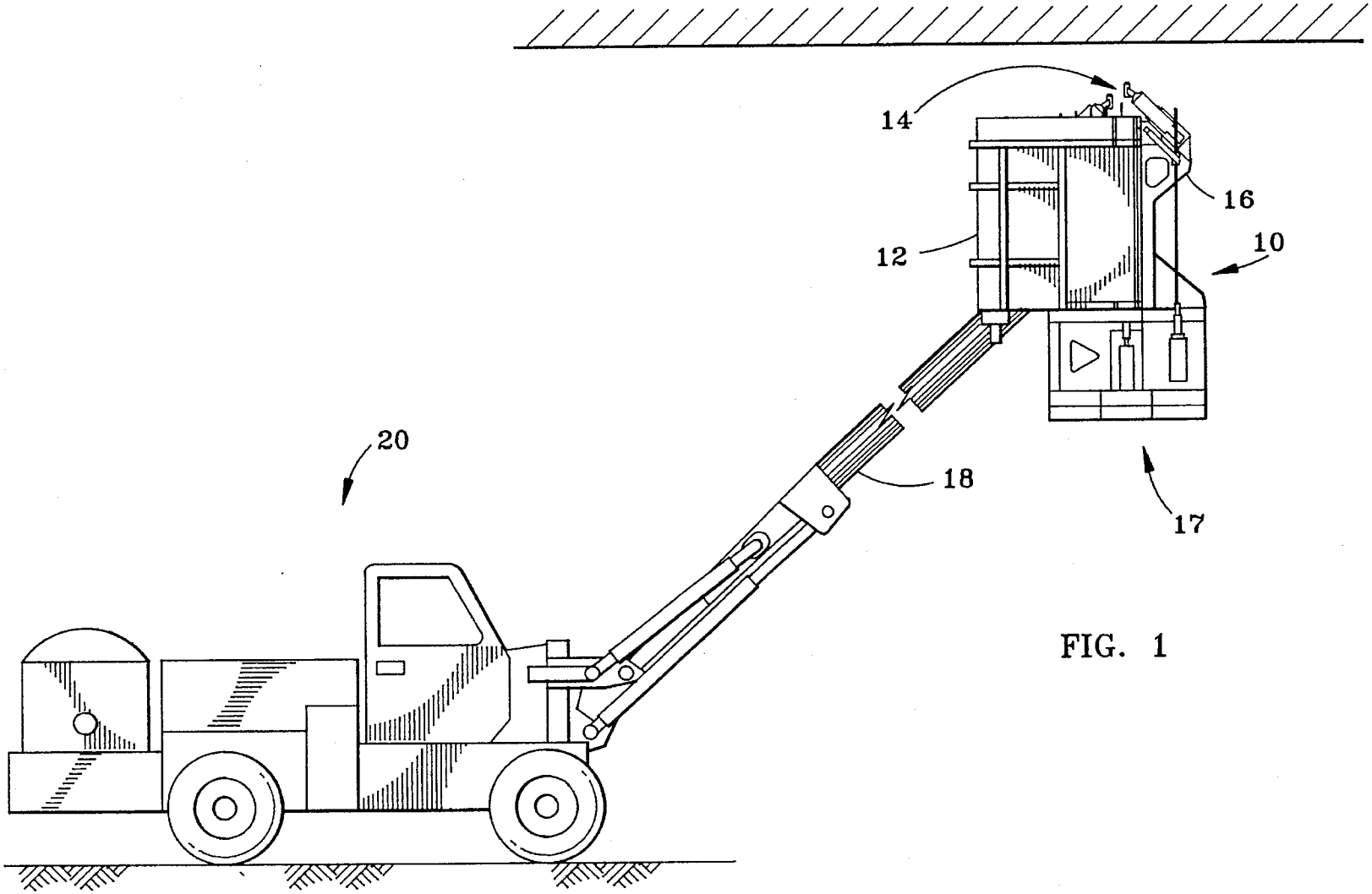
FIG. 1 is a an elevation view of a carrier vehicle on which a rock bolter is mounted. The rock bolter is shown in its roof bolting position. A stinger/centralizer and a bolt/plate magazine as well as a transfer plate are shown. In this embodiment, the stinger/centralizer and the bolt magazine are mounted to the transfer plate which in turn is attached to a boom mounted on the carrier vehicle.

FIG. 1 illustrates a rock bolter 10 of the present invention which has a bolt magazine 12 and a stinger/centralizer 14 mounted on a stinger base 16 which is part of a transfer system 17 which in turn is mounted to a boom 18 which is attached to a carrier vehicle 20.

Figure 2:
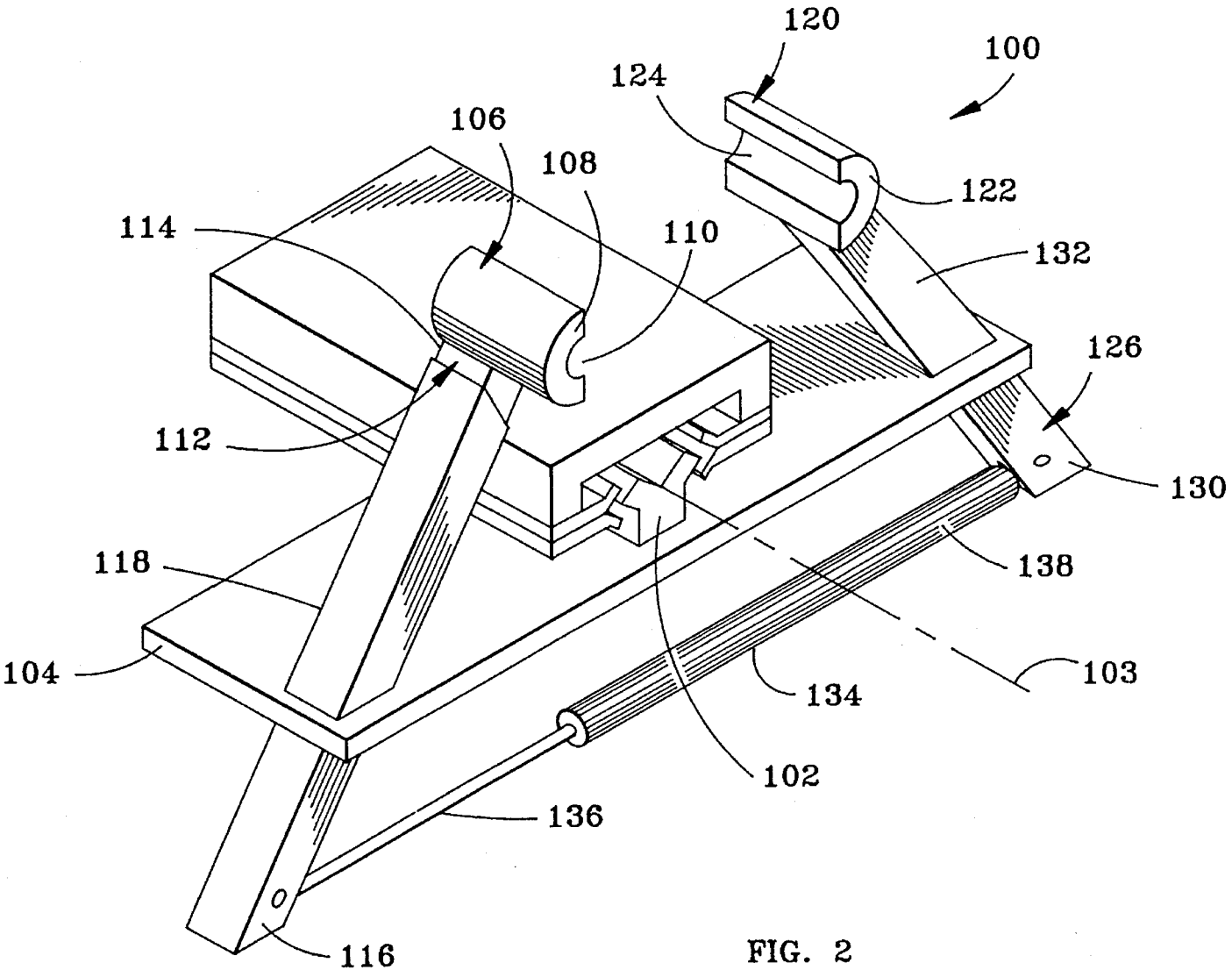
FIG. 2 is an isometric view of one embodiment of the stinger/centralizer of the present invention which employs a first head arm and a second head arm that slidably engage a base plate which is attached to a feed shell to open and close head elements which are attached to the head arms.

FIG. 2 is an isometric view of one of the embodiments of the present invention for a stinger/centralizer 100 which serves a dual purpose. The stinger/centralizer 100 stabilizes a feed shell 102, which has a feed shell axis 103, and serves as a guide for all bolt setting operations. The stinger/centralizer 100 has a base 104 which is attached to the feed shell 102. The stinger/centralizer 100 has a first head element 106 having a first head rock engaging surface 108 and a first head cavity 110. A first head arm 112 has a first head arm first end 114 and a first head arm second end 116. The first head arm first end 114 attaches to the first head element 106. The first head arm 112 slidably engages a first bracket 118 which forms a sleeve which is attached to the base 104. The first head arm 112, in combination with the first bracket 118, serves as means for movably attaching the first head element 106 to the base 104. Similarly, a second head element 120 having a second head rock engaging surface 122 and a second head cavity 124 is provided for the stinger/centralizer 100. A second head arm 126 having a second head arm first end (not shown) and a second head arm second end 130 slidably engages a second bracket 132 forming a sleeve. The second head arm first end (not shown) is attached to the second head element 120. The second head arm 126, in combination with the second bracket 132, serves as means for movably attaching the second head element 120 to the base 104.

A double action hydraulic cylinder 134 is provided. The hydraulic cylinder 134 has a stem 136 which is pivotably attached to the first head arm second end 116 and a cylinder end 138 which is pivotably attached to the second head arm second end 130. The hydraulic cylinder 134 and the stem 136 serve as the means for engaging the first head element 106 and the second head element 120. The first bracket 118, in combination with the second bracket 132, directs the path of the first head arm 112 and the second head arm 126 such that when the first head element 106 is in contact with the second head element 120, the first head element cavity 110 and the second head element cavity 124 form a passage parallel to the feed shell axis 103.

For the stinger/centralizer 100 to function as a stabilizing element for the feed shell 102 when the first head element 106 is in contact with the second head element 120, the first head rock engaging surface 108 and the second head rock engaging surface 122 must be positioned ahead of the feed shell 102 so that they will be in contact with the rock which will be drilled. When the first head element 106 and the second head element 120 move in a plane that is normal to the feed shell 102, they will rub on the rock. Thus, before the centralizer formed by the head elements 106 and 120 is opened, it is preferred that the feed shell 102 be moved away from the rock surface.

Figure 3:
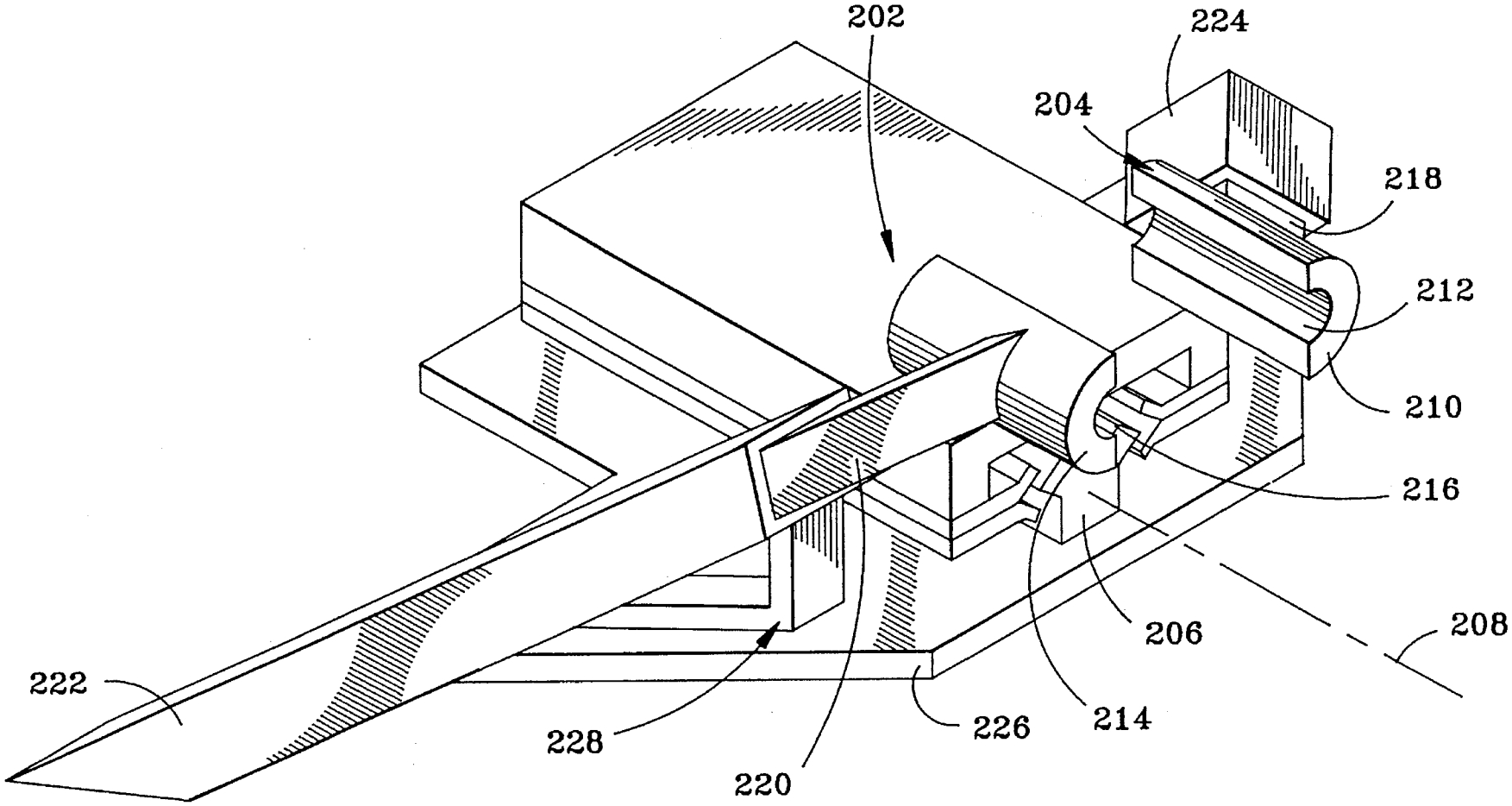
FIG. 3 is an isometric view of another embodiment of the invention similar to the embodiment for the stinger/centralizer of FIG. 2. The embodiment of FIG. 3 differs from the embodiment of FIG. 2 in that as the head elements separate, a component of the motion is parallel to the axis of the feed shell.

FIG. 3 is an isometric view of another embodiment similar to the embodiment illustrated in FIG. 2. In this embodiment, a first head element 202 and a second head element 204 are provided which are positioned with respect to a feed shell 206 having a feed shell axis 208 such that the head elements 202 and 204 meet in front of the feed shell 206 and align with the feed shell axis 208. The first head element 202 has a first rock engaging surface 214 and a first head cavity 216. Similarly, the second head element 204 has a second rock engaging surface 210 and a second head cavity 212.

As illustrated in FIG. 3, the first head element 202 is in its fully extended position while the second head element 204 is in its retracted position. When retracting the head elements 202 and 204, not only do they move in a plane normal to the feed shell axis 208, but they have a component of their motion parallel to the feed shell axis 208. This component of motion parallel to the feed shell axis 208 results from the placement of a first head arm 220 and a second head arm 218; the first head arm 220 attaches to the first head element 202 while the second head arm 218 attaches to the second head element 204.

The first head arm 220 and the second head arm 218 in turn respectively slidably engage a first bracket 222 and a second bracket 224 which in turn attach to a base 226. Additional support for the first bracket 222 is provided by a first brace 228 between the first bracket 222 and the base 226. A second brace (not shown) provides additional support for the second bracket 224.

Figure 4:
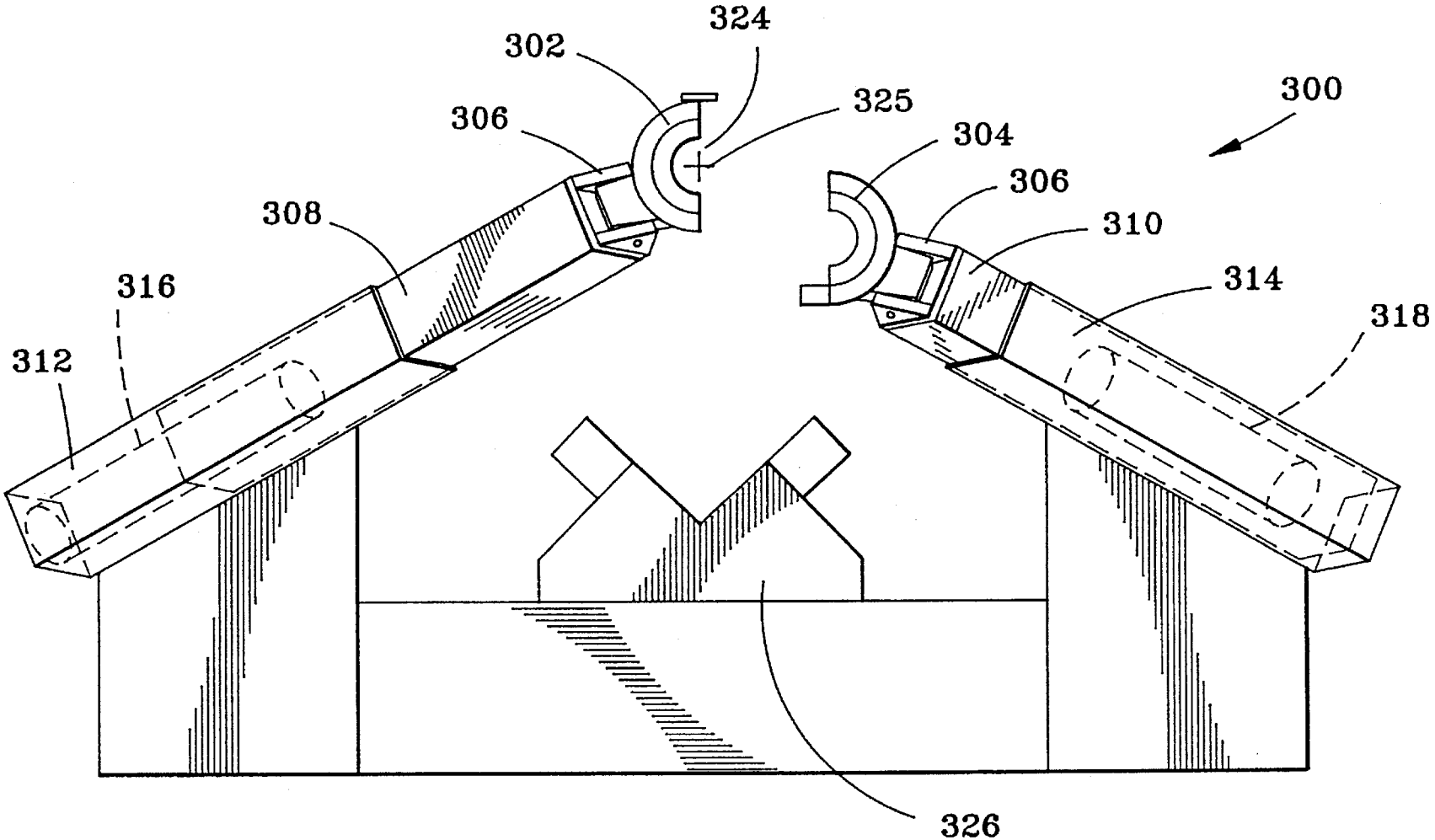
FIG. 4 is a front view,of another embodiment, similar to that of FIG. 3, for a stinger/centralizer. In this embodiment, the head of the centralizer is mounted to arms with a flexible coupling. As illustrated, one arm is fully extended, another is contracted. In this embodiment, each of the arms are driven by a separate hydraulic cylinder.

FIGS. 4 through 7 illustrate another embodiment of the stinger/centralizer that has the same head arm arrangement as is employed in the embodiment of FIG. 3. Referring to FIG. 4, a stinger/centralizer 300 is illustrated having a first head element 302 and a second head element 304 with flexible couplings 306 located between the head elements 302 and 304 and head arms 308 and 310. The head arms 308 and 310 slidably engage brackets 312 and 314. The head arms 308 and 310 are positioned in the brackets 312 and 314 with hydraulic cylinders. Each of the brackets 312 and 314 contain hydraulic cylinders which are shown in phantom lines; a first bracket hydraulic cylinder 316 resides in the first bracket 312 and a second bracket hydraulic cylinder 318 resides in the second bracket 314.

Figure 5:
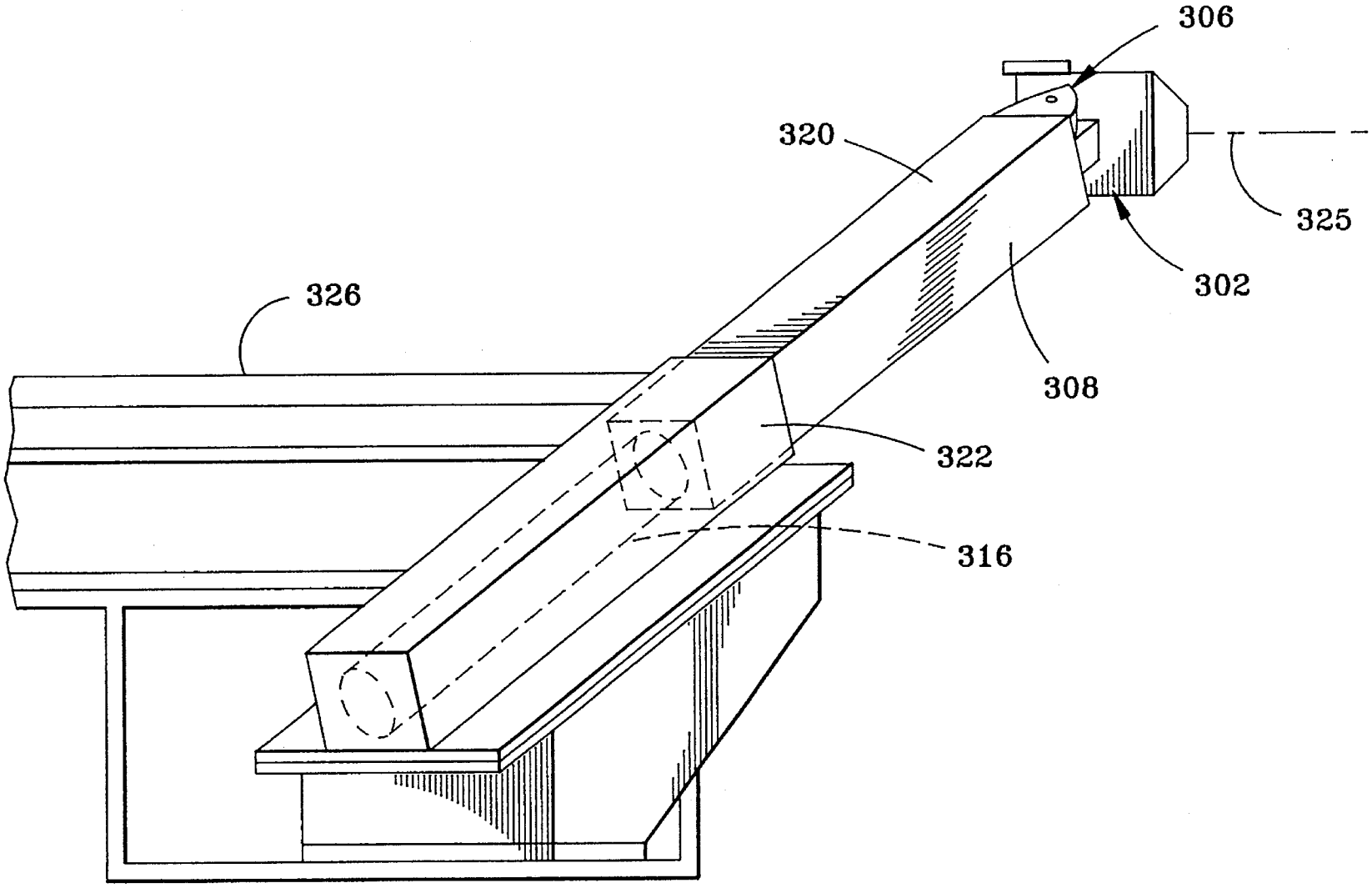
FIG. 5 is a side view of the embodiment of FIG. 4.

Referring to FIG. 5, the first head arm 308 has a first head arm first end 320 which engages the flexible coupling 306. A first head arm second end 322 of the first head arm 308 engages the first bracket hydraulic cylinder 316. The position of the first bracket hydraulic cylinder 316 is such that, at full extension of the first bracket hydraulic cylinder 316, the first head element 302 (shown in FIG. 4) will be positioned such that its first head cavity 324 can be aligned with an axis for a tool 325 which is advanced on a feed shell 326. The positioning of the cavity 324 will be properly aligned when the second head element 304 is engaged with the first head element 302.

Figure 6:
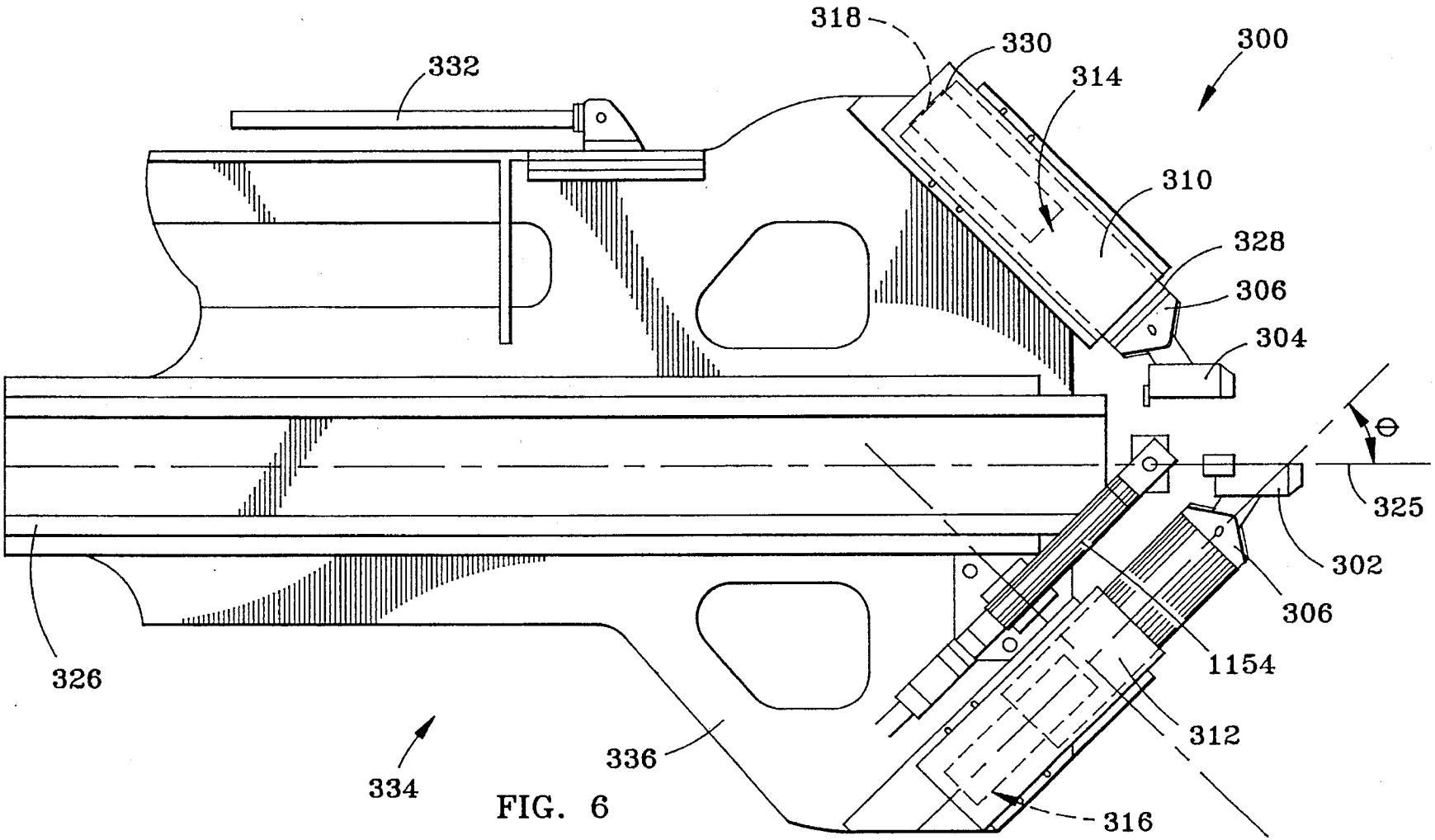
FIG. 6 is a top view of the embodiment of FIG. 4.

Referring to FIG. 6, the second head arm 310 has a second head arm first end 328 which engages the flexible coupling 306 and a second head arm second end 330 which engages the second bracket hydraulic cylinder 318. To assure a positive engagement of the first head element 302 with the second head element 304, it is preferred that the location of the second bracket hydraulic cylinder 318 be positioned such that the second head element 304 extends beyond the path of the first head element 302 if the first head element 302 were in its retracted position.

FIG. 6 also illustrates a transfer driver arm 332 which advances a transfer plate 334 which serves as a base 336 on which the stinger/centralizer 300 is mounted. The transfer driver arm 332 provides for translational motion of the transfer plate 334 relative to a boom (not shown) so that the stinger/centralizer 300 can be advanced. The advancing stinger/centralizer 300 brings the head elements 302 and 304, when closed, into contact with the rock surface to be drilled and bolted.

Figure 7:
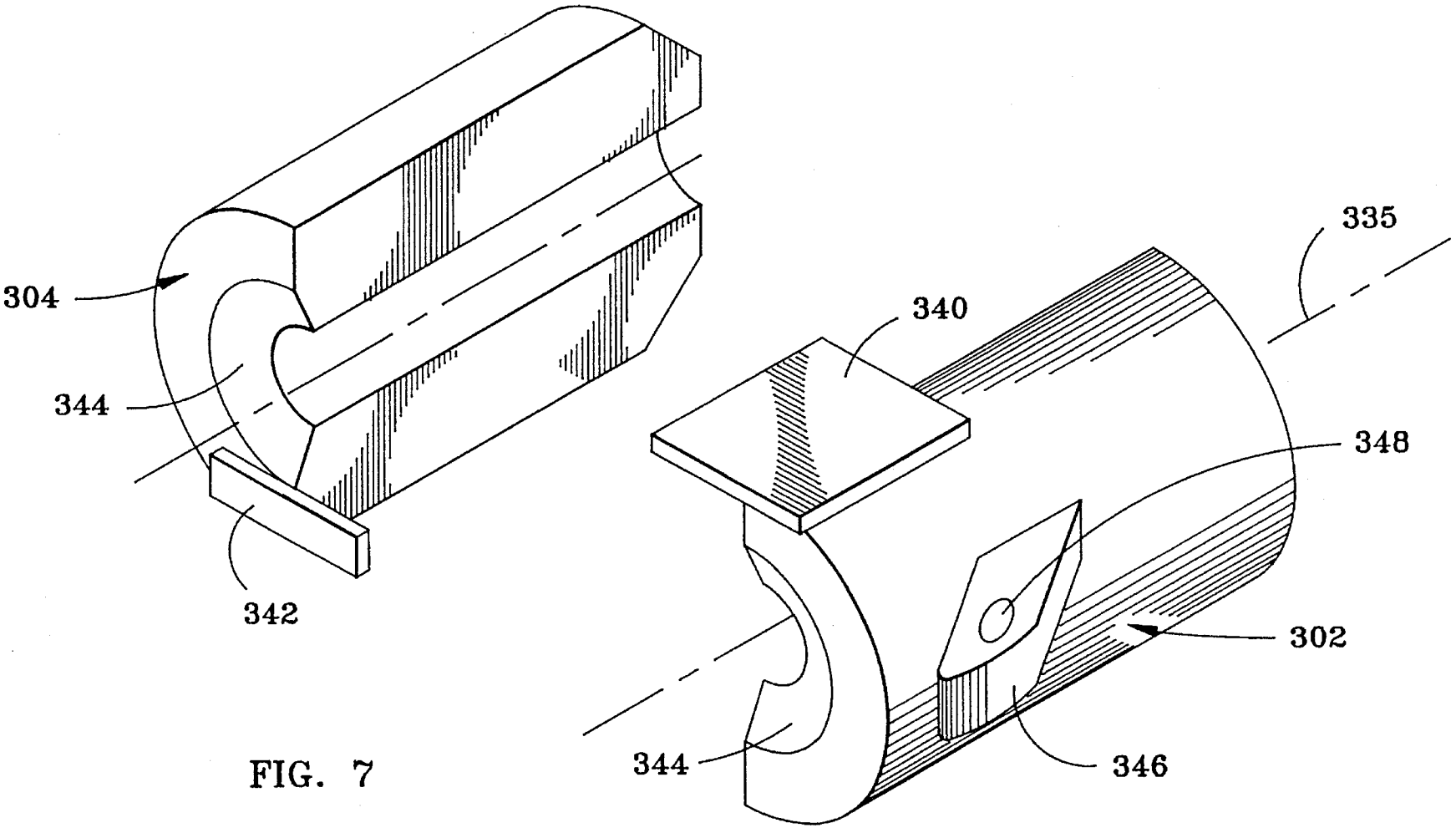
FIG. 7 is an exploded isometric view illustrating the use of tabs to assure registry between the head elements such as shown in FIGS. 4, 5 and 6. The head element illustrated also has beveled entry surfaces which facilitate the engagement of a drill steel, bolts and other bolt setting apparatus.

FIG. 7 is a rear exploded isometric view of the first head element 302 and the second head element 304 illustrating tabs which are preferably employed to maintain registry between the first head element 302 and the second head element 304, which when joined, share a common head axis 335. A top head tab 340 is attached to the top of the first head element 302 and extends there beyond to be engaged by the second head element 304. A back head tab 342 is attached to the back of the second head element 304 to engage the back of the first head element 302. These tabs serve to maintain the alignment between the two head elements 302 and 304. Beveled back surfaces 344 are provided on the first and second head elements 302 and 304 to facilitate the engagement of the drill steel, bolts and other bolt setting operations with the passage in the joined head elements 302 and 304.

When both head elements 302 and 304 are flexibly mounted with head extensions 346 (one of which is shown) pin holes 348 are provided in the head extensions 346 for pivotably mounting them on the head arms 308 and 310. Having both arms flexibly mounted with pins provides for ease in removal of the head elements 302 and 304 for replacement. If it is desired to immobilize the first head element 302, a second pin hole can be employed in the head extension 346 to immobilize the first head element 302. As an alternative, bolts rather than pins could be used to attach the head elements 302 and 304 to the head arms 308 and 310.

Figure 8:
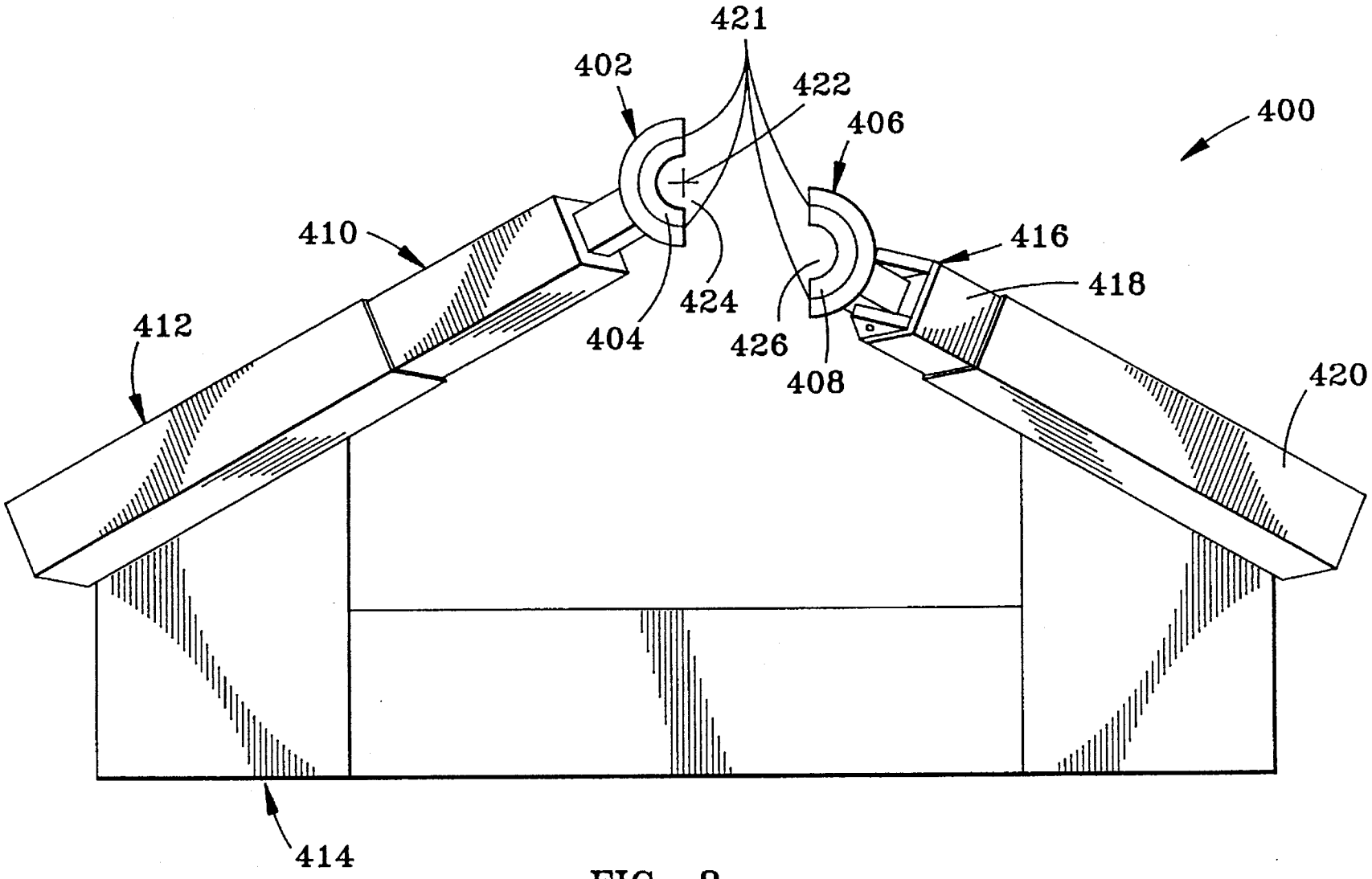
FIG. 8 illustrates a front view of an embodiment of the present invention which is similar to the embodiment illustrated in FIGS. 4 through 7 with the exception that only one head element is mounted to an arm with a flexible coupling. As illustrated, the stinger/centralizer has the head element which is rigidly mounted to an arm fully extended while the arm with the head element flexibly mounted to it is contracted.

FIG. 8 illustrates another preferred embodiment of the stinger/centralizer of the present invention. This embodiment has a similar arm arrangement to the embodiments of FIGS. 3 through 7. A stinger/centralizer 400 has a first head element 402 having a first rock engaging surface 404 and a second head element 406 having a second rock engaging surface 408. The first head element 402 is rigidly mounted to a first head arm 410. The first head arm 410 slidably engages a first bracket 412 which attaches to a stinger/centralizer base 414. The second head element 406 has a flexible coupling 416 located between the second head element 406 and a second head arm 418. The second head arm 418 slidably engages a second bracket 420 which, like the first bracket 412, is attached to the stinger/centralizer base 414. Mating surfaces 421 of the head elements 402 and 406 lie in a plane which contains a head axis 422, which is the axis of a first head cavity 424 and a second head cavity 426 when the first head element 402 and the second head element 406 are engaged.

Figure 9:
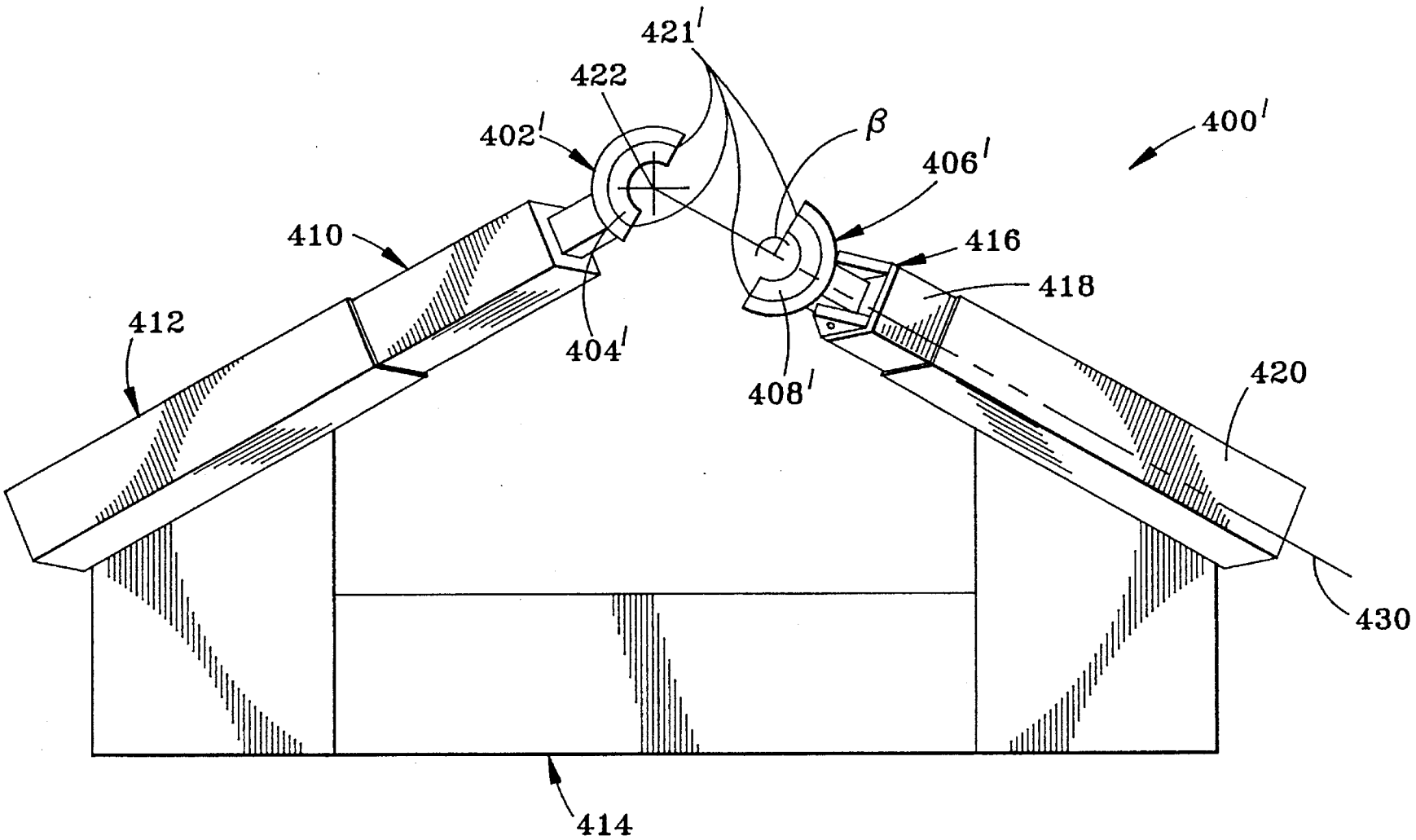
FIG. 9 illustrates an embodiment which is similar to the embodiment illustrated in FIG. 8, except that the head elements have mating surfaces which meet in a plane containing the head axis and are oriented with respect to the second arm such that the plane is essentially perpendicular to a projection of the second head arm axis on a plane normal to the head axis.

FIG. 9 has all the same elements as the embodiment of FIG. 8; however, the head elements 402' and 406' are designed to meet on an alternate plane. In FIG. 9 the first head element 402' having a first rock engaging surface 404' is rigidly attached to the first head arm 410. The second head element 406' having a second rock engaging surface 408' is pivotably connected to the second head arm 418 by the flexible coupling 416. The head elements 402 and 406 in FIG. 8 have mating surfaces 421 and the head elements 402' and 406' of FIG. 9 have mating surfaces 421' which in both cases are oriented so that the head mating surfaces 421 and 421' meet on a plane which contains the head axis 422. The distinction between the embodiment of FIGS. 8 and 9 is that the plane on which the heads 402 and 406 meet in FIG. 8 is normal to the stinger/centralizer base 414 whereas in FIG. 9 the plane has been rotated and is positioned to be essentially perpendicular to a projection of a second head arm axis 430 on a plane normal to the head axis 422. As is shown in FIG. 9, the angle $\beta$ between the trace of the second arm axis 430 onto a plane normal to the head axis 422' is about 90°. Orienting the head element plane as shown in FIG. 9 facilitates the positioning of the second head element 406' relative to the fixed position of the first head element 402'.

Figure 10:
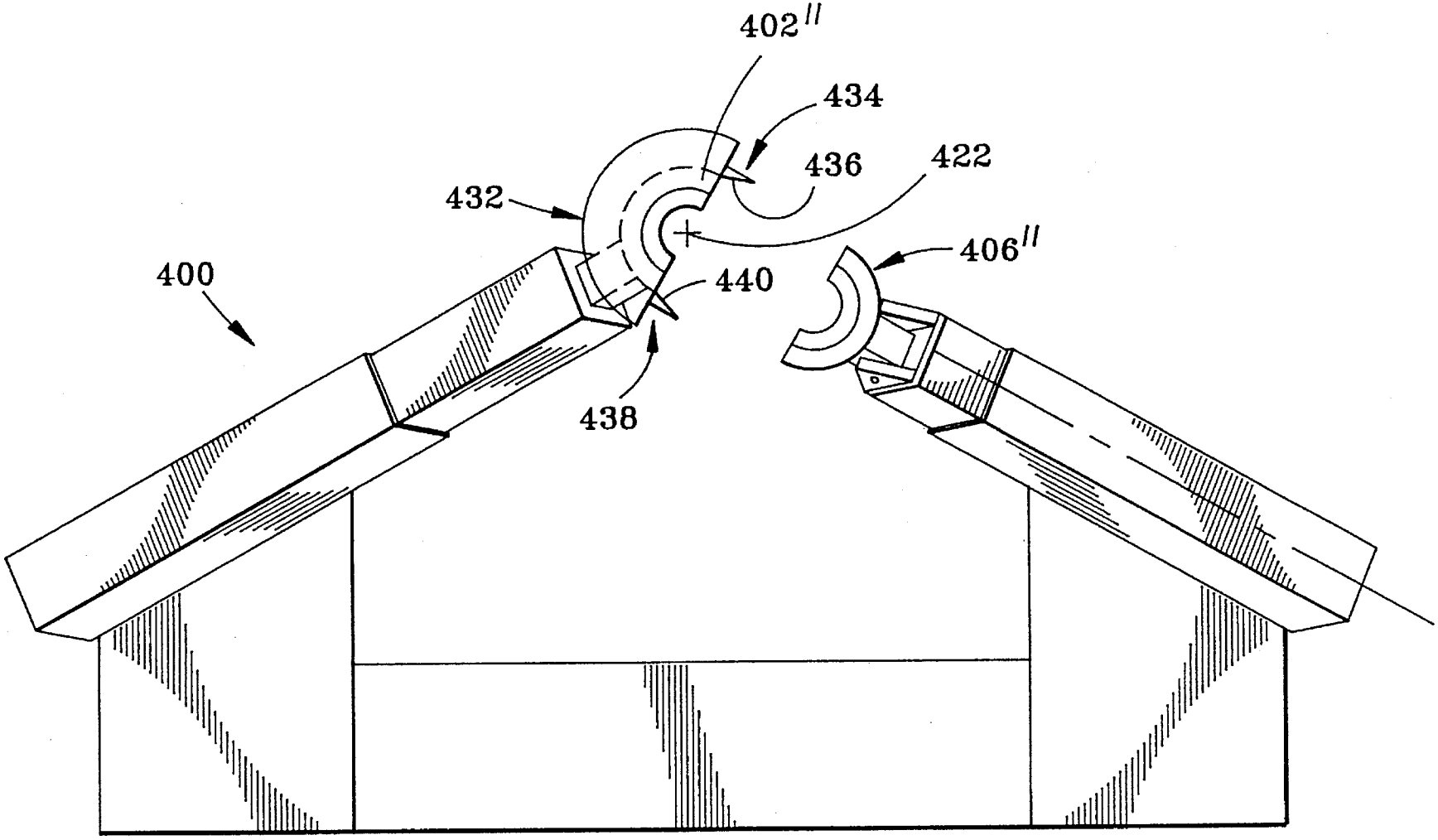
FIG. 10 illustrates an embodiment of the present invention which is similar to the embodiment of FIG. 9; however, this embodiment employs a compliant pad on the rock engaging surface of the first head element to increase surface contact between the head element and the rock surface.
Figure 11:
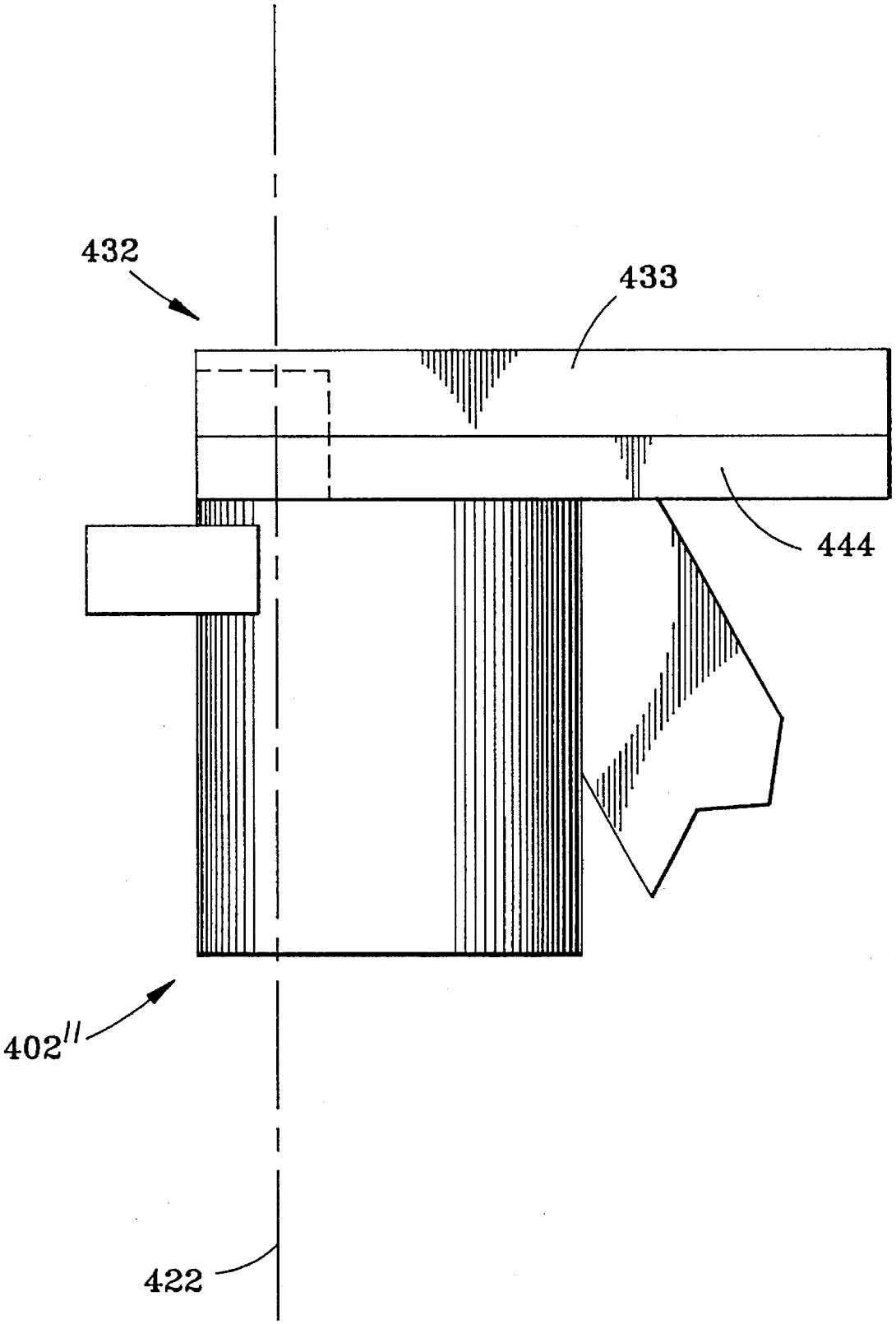
FIG. 11 is a top view of the first head element of the embodiment of the invention illustrated in FIG. 10 illustrating the detail of the rock engaging surface extender and its connection to the first head element.

FIGS. 10 and 11 illustrate a modification of the stinger/centralizer of FIG. 9. A rock engaging surface extender 432 is attached to the first head element 402" of the stinger/ centralizer 400 creating an enlarged rock engaging surface for the first head element 402". The rock engaging surface extender 432 has a rock engaging layer 433 which is a compliant material such as an elastomer such as urethane or rubber to increase the surface of contact between the head element 402" and the rock surface which may be rough.

A top tab 434 is attached to the first head element 402". The top tab 434 has a tapered face 436 which engages the second head element 404" as the head elements 402" and 406" engage each other. Similarly, a bottom tab 438 is provided which is also attached to the first head element 402" and has a tapered face 440 which engages the second head element 406" as the head elements 402" and 406" are engaged. These tabs 434 and 438 assure alignment of the head elements 402" and 406" as they close to form the centralizer. While the tabs 434 and 438 have been provided on the first head element 402" it should be appreciated that the tabs 434 and 438 could be placed on the second head element 404".

A top view of the first head element 402" illustrating the rock engaging surface extender 432 of FIG. 10, is shown in FIG. 11. A support structure to support the rock engaging surface extender 432 has a support plate 444 which is substantially normal to the head axis 422 and attaches to the head element 402". While the use of a rock engaging surface extender has been discussed as it relates to one embodiment of the present invention, it should be appreciated that a rock engaging surface extender could equally well be added to any of the other embodiments of the stinger/centralizer of the present invention.

FIGS. 12 through 15 illustrate another embodiment of a stinger/centralizer 500 of the present invention. A stinger base 502 is provided for the stinger/centralizer 500 which is attached to a feed shell 504 of a rock bolter such as shown in FIG. 1. A first head element 506 has a first head rock engaging surface 508 (best illustrated in FIGS. 14 and 15) which engages the rock surface which is to be drilled. The first head element 506 is attached to a first head arm 510 which serves as a means for movably attaching the first head element 506 to the stinger base 502. The first head element 506 has a first head cavity 512 therein (best shown in FIG. 15). The first head cavity 512 extends through the first head rock engaging surface 508.

Figure 14:
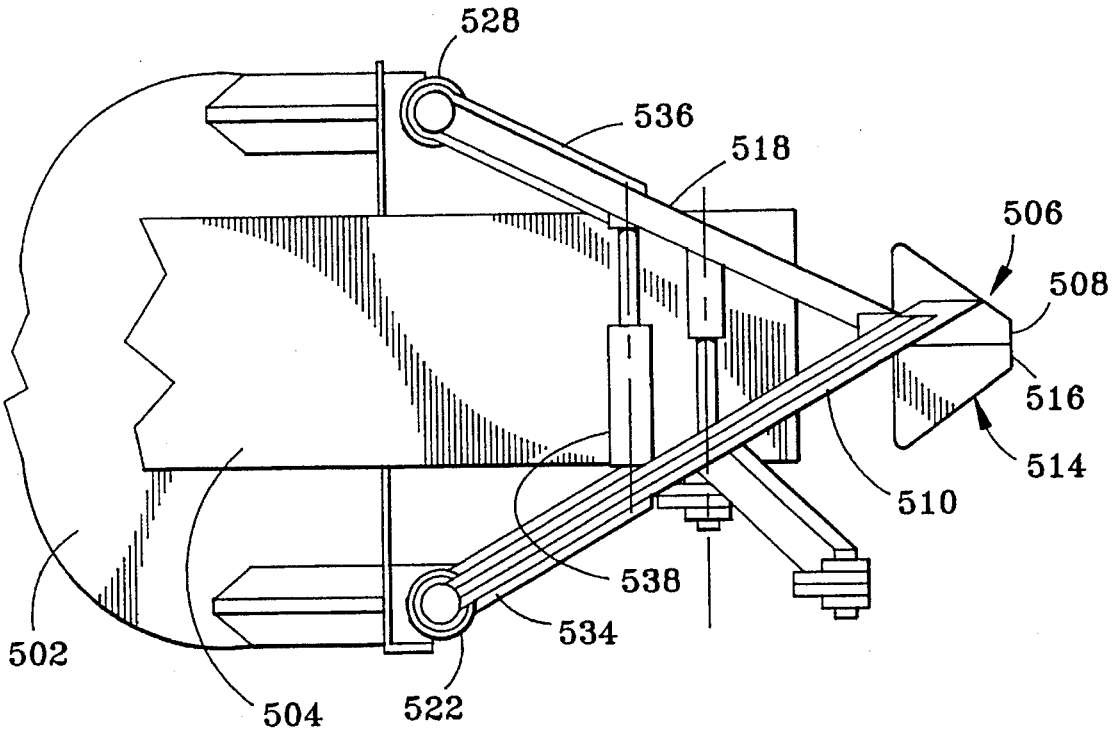
FIG. 14 is a top view of the embodiment of FIG. 12.
Figure 15:
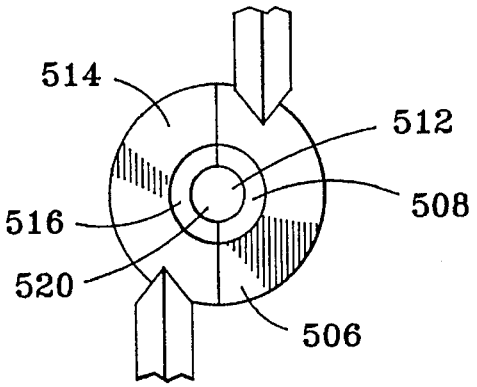
FIG. 15 is an enlarged view of the region encircled in FIG. 13.

A second head element 514 has a second head rock engaging surface 516 which engages the rock surface which is to be drilled. The second head element 514 is attached to a second head arm 518 which serves as means for movably attaching the second head element 514 to the stinger base 502 as shown in FIG. 14. The second head element 514 has a second head cavity 520 therein as shown in FIG. 15. The second head cavity 520 extends through the second head rock engaging surface 516.

A first bracket 522 attaches to the stinger base 502 or alternatively can be made an integral part thereof (best shown in FIG. 12). A first pivot post 524 is rotatably engaged in the first bracket 522 and attached to the first head arm 510 providing for the pivotable engagement of the first head arm 510 with the first bracket 522 as shown in FIG. 13. Additional support for the first pivot post 524 can be provided by a first supplemental bracket 526.

A second bracket 528 attaches to the stinger base 502 or alternatively, can be made an integral part thereof (best shown in FIG. 13). A second pivot post 530 is rotatably engaged in the second bracket 528 and attached to the second head arm 518 providing for the pivotable engagement of the second head arm 518 with the second bracket 528. As shown in FIG. 13, additional support for the second pivot post 530 can be provided by a second supplemental bracket 532.

In the embodiment illustrated in FIGS. 12 through 15, a first torque arm 534 (best shown in FIG. 13) is attached to the first pivot post 524 and a second torque arm 536 is attached to the second pivot post 530. An extendable connector 538 is provided which is pivotably connected to the first torque arm 534 and the second torque arm 536 as shown in FIG. 13. For the embodiment shown in FIGS. 8 through 11, a pneumatic cylinder is employed as the extendable connector 538 (illustrated in the embodiment in FIGS. 12 through 15). The extendable connector 538 rotates the torque arms 534 and 536 which in turn causes rotation of the head arms 510 and 518, changing the separation between the first head element 506 and the second head element 514.

In the embodiment shown in FIGS. 12 through 15, the motion of the rock engaging surfaces 508 and 516 will have a component which moves the head elements 506 and 514 away from the rock surface. This motion results from moving the head arms 510 and 518 connected to the stinger base 502 such that when the head elements 506 and 514 are engaged, the head arms 510 and 518 cross. Having the head arms 510 and 518 so positioned assures that the head elements 506 and 514 will swing in arcs that take the head arms 510 and 518 away from the rock surface as the head elements 506 and 514 are opened.

To further facilitate the opening of the head elements 506 and 514 when the bolter is placing bolts on uneven surfaces, it is advantageous to have the head arms 510 and 518 displaced as far as possible from the rock surface. For this reason, it is also preferred that the first head arm 510 have two segments. A first base arm segment 560 is spaced apart from a central axis 562 of the centralizer passage as shown in FIG. 12. The first base arm segment 560 attaches to the stinger base 502. A first head element arm segment 564 of the first head arm 510 attaches to the first base arm segment 560 completing the first head arm 510. The first head element arm segment 564 is inclined with respect to the central axis 562 by an angle θ of about 45° as shown in FIG. 12. Similarly, the second head arm 518 preferably has two segments. A second base arm segment 566 is spaced apart from the central axis 562 of the centralizer passage and attaches to the stinger base 502. A second head element arm segment 568 attaches to the second base arm segment 566. The second head element arm segment 568 is inclined with respect to the central axis 562 by an angle θ of about 45°. This angular relationship is also preferably maintained with the slidable arm embodiment illustrated in FIGS. 1 through 7. In which case θ is measured between the slidable arms and the axis of the centralizer.

Figure 16:
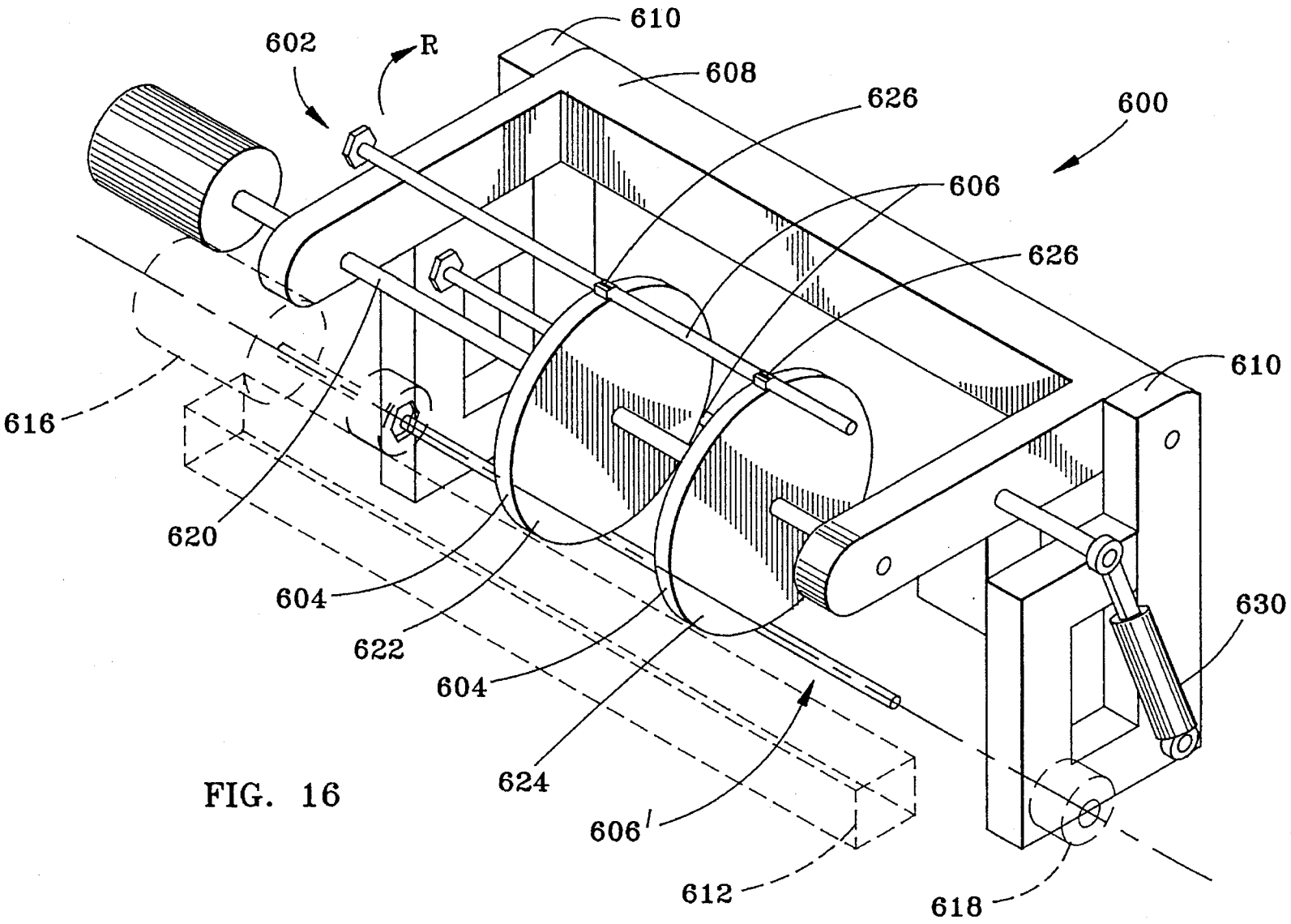
FIG. 16 is an isometric view of one embodiment of the present invention for a bolt delivery system where the bolts are mounted on wheels employed to advance the bolts.

FIG. 16 illustrates an isometric view of one embodiment of a bolt delivery system 600 of the present invention. The bolt delivery system 600 has a bolt magazine 602 which has advancable peripheral surfaces 604 which support and transport bolts 606. The bolt magazine 602 has a first bolt retaining shaft 620 which is rotatably mounted in a bolt magazine holder 608. The first bolt retaining shaft 620 has a first wheel 622 mounted thereon which has a rim which serves as one of the peripheral surfaces 604 of the bolt magazine 602. Mounted on the first bolt retaining shaft 620 and spaced apart from the first wheel 622 is a second wheel 624 having a rim which provides another of the peripheral surfaces 604 of the bolt magazine 602.

Clips 626 are mounted on the first wheel 622 and the second wheel 624 and are positioned on the peripheral surfaces 604 of the wheels 622 and 624 providing paired clips thereon. The clips 626 are paired so that the bolts 606, mounted in paired clips 626, are parallel to the first bolt retaining shaft 620. The bolt magazine 602 is supported by the magazine holder 608 which in turn is pivotably mounted to a magazine base 610. The magazine base 610 is mounted in a fixed relationship to a feed shell 612. The magazine holder 608 is mounted such that when the bolt 606' is engaged by a bolt driver 616 and advanced into a bolt centralizer 618, the bolt 606' can be removed from the bolt magazine 602 by withdrawing it substantially normal to the peripheral surfaces 604 of the bolt magazine 602. Having the bolt 606' so positioned facilitates the removal of the bolt 606' from the paired clips 626' (not shown) since the line of force will be along the radius of the wheels 622 and 624.

The bolt magazine holders 608, as illustrated, is in the work position. In this position, the bolt 606' is aligned with the bolt driver 616 and will be advanced as the bolt driver 616 moves along the feed shell 612. When the bolt 606' has been engaged by the bolt driver 616 and the bolt centralizer 618, the bolt magazine holder 608 is raised to a park position by rotating it on the magazine base 610. A hydraulic cylinder 630 is pivotably connected to the bolt magazine holder 608 and the magazine base 610. When the hydraulic cylinder 630 is extended, the bolt magazine 602 will pivot as illustrated by the arrow R, raising the bolt magazine 602 to a park position. The park position allows the bolt driver 616 to pass by the bolt magazine 602 and the bolt 606' to be driven into the drilled hole in the rock.

Figure 17:
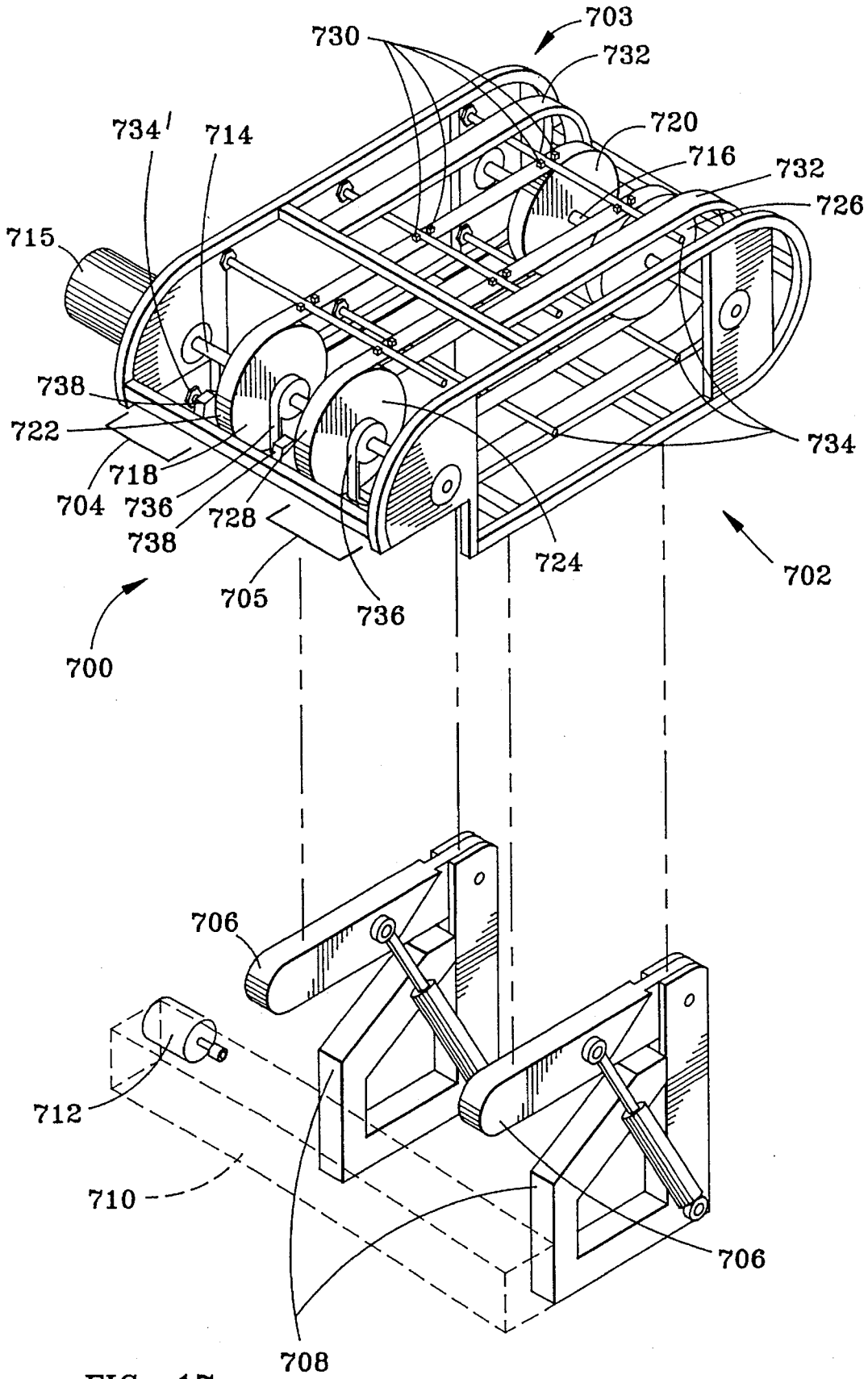
FIG. 17 is an isometric view of an embodiment of the present invention for a bolt delivery system including a bolt magazine. In this embodiment, belt/chains are employed to advance the bolts. Fingers, in combination with bolt retaining bars are used to hold and advance the bolts on the belt/chains.

FIG. 17 is an isometric view of another embodiment for a bolt delivery system 700 of the present invention. In this embodiment, the cross section of a bolt magazine 702 is oval rather than circular. Oval cross sections allow a greater number of bolts per unit cross section than circular cross sections. The bolt magazine 702 has a magazine frame 703 which has a bolt head region 704 and a bolt exit region 705. The bolt magazine 702 is attached to a magazine holder 706 which is pivotably mounted to a magazine base 708 which is mounted in a fixed relationship With a feed shell 710 on which a bolt driver 712 rides. The bolt magazine 702 has a first bolt retaining shaft 714 rotatably mounted on the magazine frame 703 and powered by a motor 715. A second bolt retaining shaft 716, spaced apart from the first bolt retaining shaft 714, is also rotatably mounted on the magazine frame 703. A first pulley/sprocket 718 is mounted on the first bolt retaining shaft 714, while a second pulley/sprocket 720 is mounted on the second bolt retaining shaft 716. A first belt/chain 722 engages the first pulley/sprocket 718 and the second pulley/sprocket 720. Belts are usually used in combination with pulleys while sprockets will be used in combination with chains. The use of chains and sprockets is preferred since the interlocking character of the chain with the sprocket helps maintain registry of the bolts as they are advanced.

Similarly, a third pulley/sprocket 724 is mounted on the first bolt retaining shaft 714 and is spaced apart from the first pulley/sprocket 718. A fourth pulley/sprocket 726 is mounted on the second bolt retaining shaft 716 and is spaced apart from the second pulley/sprocket 720. A second belt/chain 728 engages the third pulley/sprocket 724 and the fourth pulley/sprocket 726. The pulley/sprockets are so positioned that the first belt/chain 722 and the second belt/chain 728 are parallel.

In the embodiment of FIG. 17, fingers 730 are employed in combination with bolt retaining bars 732 and serve as the bolt mounts for holding bolts 734 as the belt/chains 722 and 728 are advanced. If a single bolt retaining bar is employed, it should be centrally located between the first belt/chain 722 and the second belt/chain 728. When two bolt retaining bars 732 are employed, one bolt retaining bar 732 should be located in the bolt head region 704 of the magazine frame 703 while the other bolt retaining bar 732 should be in the bolt exit region 705 of the magazine frame 703. The bolt retaining bars 732 are provided with exit openings (not shown) to allow the bolts 734 to be withdrawn from the bolt magazine 702. The fingers 730 are attached in a pair-wise manner to the first belt/chain 722 and the second belt/chain 728 such that the bolts 734 will be parallel to the first bolt retaining shaft 714 and the second bolt retaining shaft 716.

Bolt followers 736 are pivotably mounted on the first bolt retaining shaft 714 and are biased by springs (not shown). The bolt followers 736 engage the bolt 734' when it reaches the bolt retaining bar exit opening (not shown) in the bolt retaining bars 732. The bolt followers 736 maintain the bolt 734' between the fingers 730 while the bolt 734' advances to the position where it is engaged by the bolt driver 712. Bolt stops (not shown) which are supported by brackets 738 attach to the magazine frame 703. The bolt stops are positioned to engage the bolt 734' and position it for engagement with the bolt driver 712. Bolt stops are shown and discussed in greater detail with respect to FIG. 21.

Figure 18:
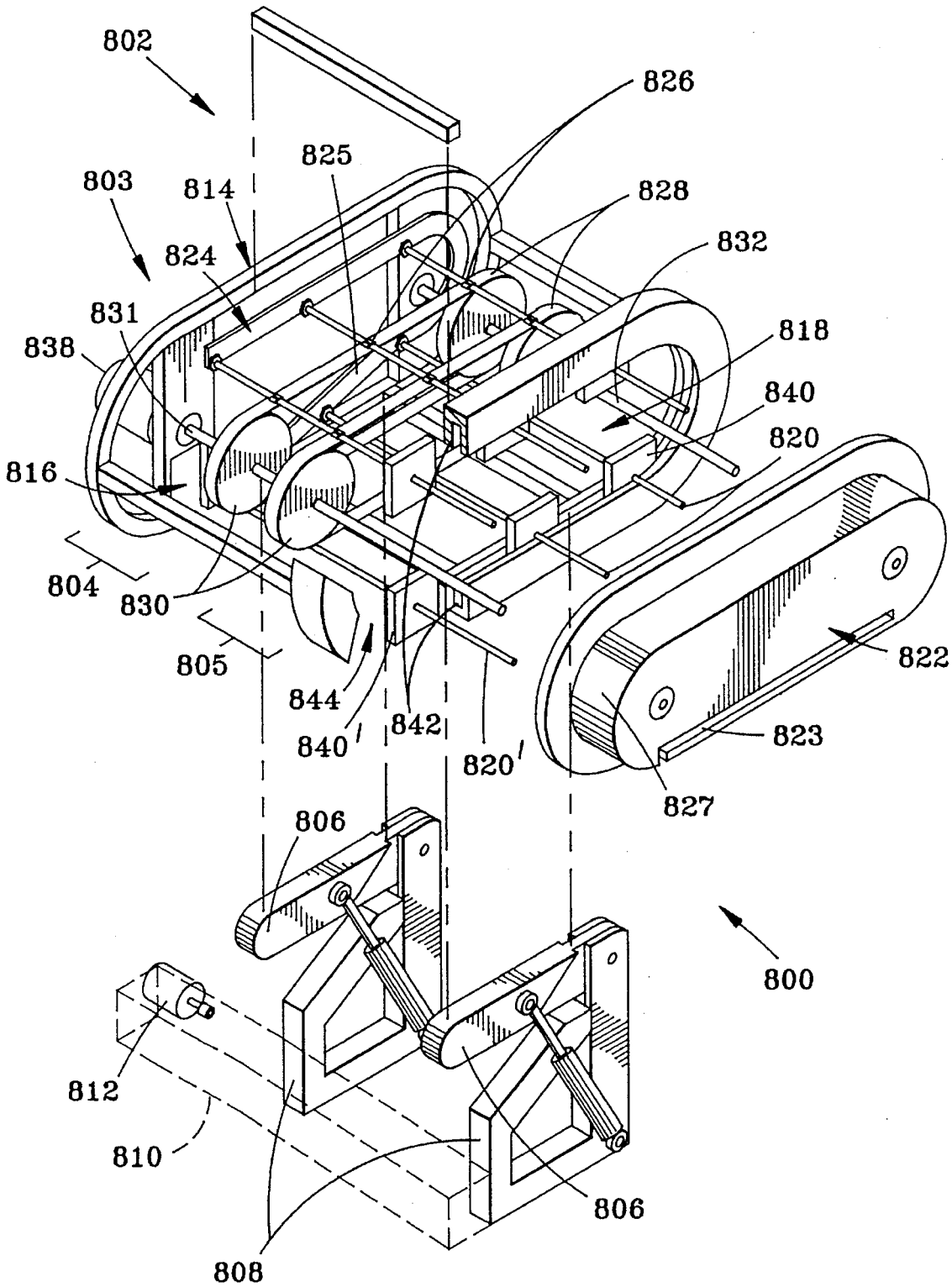
FIG. 18 is an isometric view of a second embodiment of the bolt magazine of the present invention which employs a magazine cap. This embodiment employs a magazine which has clips holding and advancing the bolts beings transported on belts.

FIG. 18 illustrates another embodiment of a bolt delivery system 800 of the present invention. A bolt magazine 802 has a magazine frame 803, having a bolt head region 804 and a bolt exit region 805. The bolt magazine 802 is attached to a magazine holder 806 which is pivotably attached to a magazine base 808, which in turn is mounted in a fixed relationship to a feed shell 810. The feed shell 810 directs the tools which are selectively mounted on the feed shell 810 to perform various rock bolting operations. During the bolt driving operation, a bolt driver 812 is slidably engaged with respect to the feed shell 810. The magazine frame 803 has a rear panel 814 which forms a terminal surface of the magazine frame 803. The rear panel 814 has a bolt driver passage 816. In this embodiment of the invention, the bolt exit region 805 has an open central region 818 through which bolts 820 can freely rotate. The open central region 818 is provided so that the bolts 820 can be advanced as they move along an oval path to the position where they will be engaged by the bolt driver 812. A removable magazine cap 822 attaches to the bolt exit region 805 of the magazine frame 803. The magazine cap 822 can be attached with screws (not shown). An extended bolt exit port 823 is provided which allows the bolts 820 to protrude beyond the magazine cap 822 as the bolts 820 advance to the position where they are engaged by the bolt driver 812. The bolts 820 are advanced as they proceed along the bolt exit port 823 by a rub rail 824 which has a forward sloping segment 825 forming a ramp which displaces the bolts 820 as they pass through the extended bolt exit port 823 and advance to the position where they are engaged by the bolt driver 812.

The bolts 820 are held in position by bolt clips 826 which attach to belt/chains 828 that are mounted on pulley/sprockets 830 which are discussed in greater detail with regard to FIG. 22. Pulley/sprockets 830 are in turn mounted on bolt retaining shafts 831 and 832. The bolt retaining shafts 831 and 832 in turn are mounted on the rear panel 814 and the magazine cap 822. Since the clips 826 are employed to hold the bolts 820 in place, there is no need for bolt followers as used in the embodiment of FIG. 17.

When the bolt clips 826 are replaced with fingers such as used in the embodiment of FIG. 17, the rub rail 824 provides another function which is to prevent the bolts 820 from slipping through the open region of the rear panel 814. A bolt retaining bar (not shown but similar to the bolt retaining bar illustrated in FIG. 17) is employed, and the bolt 820' is positioned for engagement with the bolt driver 812 by the rub rail 824. If a motor 838 used to drive the belt/chains 828 through the bolt retaining shaft 831 is a stepping motor, then stops may be omitted.

It is further preferred that the bolt magazine 802 serve in the dual capacity of carrying bolts 820 and bolt plates 840. The dual capacity magazine can be described as a bolt and bolt plate magazine. In which case a bolt plate channel 842 is provided and positioned in the bolt exit region 805 of the magazine frame 803. (The bolt plate channel 842 has been shown with a section deleted to reveal the underlying structure.) The bolt plate channel 842 serves as a bolt plate guide. The bolt plate channel 842 has a bolt plate opening 844 of sufficient size that a bolt plate 840' will pass therethrough. The bolt plate channel 842 can also serve the function of a bolt retaining bar when contoured to embrace the bolts 820 as they advance through the bolt magazine 802. Alternatively, the removable magazine cap 822 can serve as a bolt retaining bar, provided that it has a cap sidewall 827 contoured to embrace the bolts 820 as they advance through the bolt magazine 802.

Figure 19:
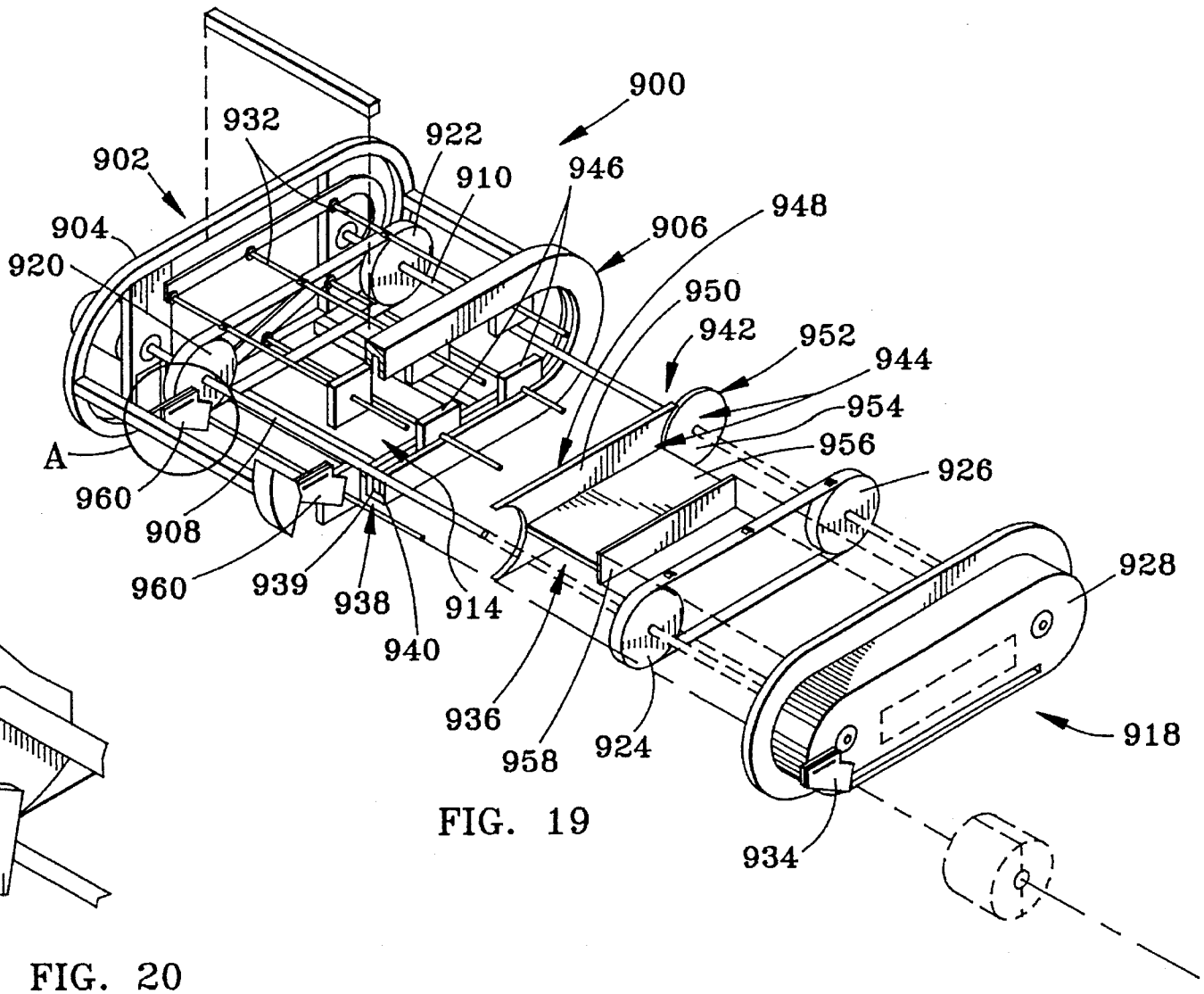
FIG. 19 is a partially exploded isometric view of an embodiment of the present invention similar to the embodiment of FIG. 18. In this embodiment, as in the embodiment illustrated in FIG. 18, the bolt retaining shafts extend through an open central region of the magazine frame and rotatably engage the first frame end of the magazine and engage the magazine cap. The embodiment illustrated in FIG. 19 also includes an inner bolt plate guide which provides additional support for the bolt plates and compliments the support provided by the bolt plate channel.

FIG. 19 illustrates a preferred embodiment of a bolt delivery system similar to FIG. 18. A bolt magazine 900 has a magazine frame 902 terminating in a first frame end 904 and a second frame end 906. The first frame end 904 forms the rear panel of the magazine frame 902. Bolt retaining shafts 908 and 910 are rotatably engaged in the first frame end 904, extend through an open central region 914 of the second frame end 906 and rotatably engage a magazine cap 918. A first pulley/sprocket 920 is mounted on the first bolt retaining shaft 908 and a second pulley/sprocket 922 is mounted on the second bolt retaining shaft 910 and positioned in the magazine frame 902. A third pulley/sprocket 924 and a fourth pulley/sprocket 926 are mounted respectively on the first bolt retaining shaft 908 and the second bolt retaining shaft 910. In the embodiments of FIGS. 17 and 18, the four pulley/sprockets are all contained within the confines of their respective magazine frames. In the embodiment illustrated in FIG. 19, the third and fourth pulley/sprockets 924 and 926 are positioned in the magazine cap 918 and in close proximity to a cap top surface 928 to decrease the bending moment experienced by a bolt 932 when engaged by a cap bolt stop 934.

In the embodiment of FIG. 19 an inner bolt plate guide 936 is provided which, in combination with a bolt plate channel 938, forms a bolt plate magazine. The bolt plate channel 938 has an inner guide wall 939 and an outer guide wall 940. The bolt plate channel 938 is situated in close proximity to the second frame end 906. The inner bolt plate guide 936 has a platform 942 having a platform surface 944 which resides in the open central region 914 of the second frame end 906 and in part supports bolt plates 946. The platform surface 944 is substantially coplanar with the inner guide wall 939 of the bolt plate channel 938 and is so positioned to provide additional support for the bolt plates 946 as they pass through the open central region 914. For ease of assembly of the magazine, it is preferred that the platform 942, which is modular, have a central platform 948 which has a central platform surface 950 and a disk platform 952 which has a disk platform surface 954. The disk platform 952 is mounted on the second bolt retaining shaft 910 and provides continuation of the central platform 948. The central platform 948 is positioned between the first and second bolt retaining shafts 908 and 910 and contoured to minimize the gap between the central platform 948 and the disk platform 952. A web 956 is attached to the central platform 948 and passes between the third and fourth pulley/sprockets 924 and 926. The web 956 terminates in an anchor plate 958 which is oriented normal to the web 956 and attaches on the inside of the magazine cap 918 to the cap top surface 928.

Figure 20:
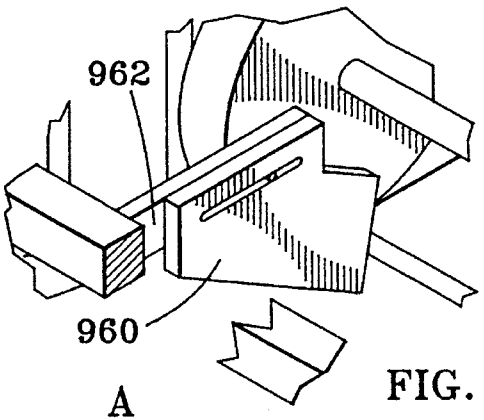
FIG. 20 is an enlargement of the section circled in FIG. 19 which shows details of a bolt stop and its mounting bracket for attaching the bolt stop to the magazine frame.

The embodiment of FIG. 19, in addition to having the cap bolt stop 934, has two bolt stops 960. A detailed view of one of the bolt stops 960 is shown in FIG. 20. The bolt stop 960 attaches to a brace 962 which in turn is affixed to the magazine frame 902.

FIG. 21 illustrates details of a follower 1000 and a bolt stop 1002 employed with a bolt magazine 1006 having chains 1008 which engage sprockets (not shown). The bolt magazine 1006 is similar to the bolt magazine 702 illustrated in FIG. 17. As illustrated in FIG. 21, the chains 1008 are used to transport bolts 1010 with fingers 1012 that are attached to individual links 1014. A bolt retaining bar 1016, in combination with the fingers 1012, confines the bolts 1010 as they advance towards the position where one of the bolts 1010' is engaged by a bolt driver (not shown). The follower 1000 is pivotably mounted on a bolt retaining shaft 1018. The follower 1000 is biased with a spring (not shown) pivoting to engage the bolts 1010 before contact with the bolt retaining bar 1016 is lost. The follower 1000 will be rotated by the advancing bolt 1010' holding it against the finger 1012' by the spring tension until such time as the bolt 1010' is stopped by the bolt stop 1002, where the bolt 1010' will be engaged by the bolt driver (not shown). The follower 1000 is contoured with a slope such that as the bolt magazine 1006 is pivoted to remove the bolt 1010' from the bolt magazine 1006, the follower 1000 will pivot on the bolt retaining shaft 1018 allowing the bolt 1010' to be released. The finger 1012', in contact with the bolt 1010', will also pivot due to the flexibility in the chain 1008', allowing the bolt 1010' to be released.

FIG. 22 is an exploded isometric view of a pair of chain links and their associated fingers. Both of the links have extensions thereon. A first link 1020, having a first link face 1022, has a pair of orthogonal extensions 1024 which are substantially normal to the first link face 1022 and substantially coplanar with each other. A second link 1026, having a second link face 1028, has a pair of parallel extensions 1030 which are substantially parallel to the second link face 1028. The pairs of parallel extensions 1030 form a first finger which leads the bolt as the bolt is advanced. A finger block 1032 is attached to the pair of orthogonal extensions 1024 forming a second finger for advancing the bolt. Since the bolts are advanced by the finger blocks 1032, the finger blocks 1032 bear the pressure of the bolt and have sufficient rigidity not to be bent as the bolts are advanced into the centralizer. The first link 1020 and the second link 1026 are attached to one another in an alternating fashion to form the chain 1008.

FIG. 23 is a bolt magazine 1050 similar to the bolt magazine 802 of FIG. 18; however, sprockets 1052 are shown which engage and advance chains 1054. Clips 1056 are provided to hold bolts 1058 in position on the chains 1054 as they are advanced. When the clips 1056 are employed, their gripping action eliminates the necessity of a follower, in which case, only a bolt stop 1060 need be employed. The bolt stop 1060 is adjustable and attaches to a brace 1062 which forms part of a magazine frame 1064. The elasticity of the clips 1056 will facilitate the release of the bolt 1058' as the magazine 1050 is pivoted away from its work position. The release is also facilitated by having the bolt 1058' being removed from the engaging clip (not shown) substantially normal to the chains 1054.

It should be noted, as illustrated in FIGS. 17 and 18, it is preferred that the powered sprocket for the bolt magazine be the sprocket supporting the chains where the bolt is being removed, thereby reducing any backlash associated with the chains.

In addition to the features discussed above, there are two additional features worthy of note: a drill steel guide and a bolt driver stop.

Figure 24:
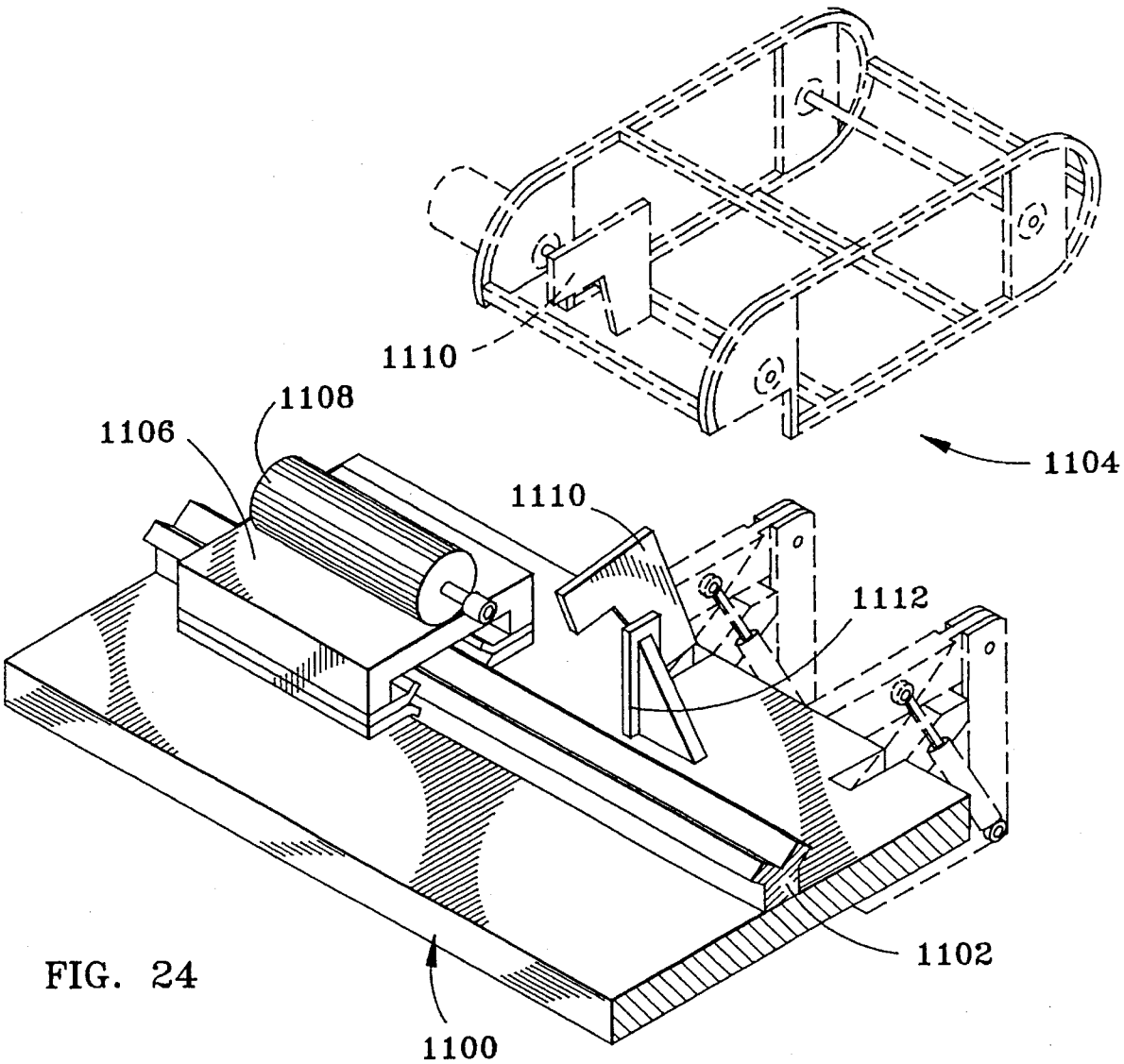
FIG. 24 is an isometric view of a section of a transfer platform for the rock bolter showing a bolt driver stop which limits the advance of the bolt driver until such time as the bolt magazine is parked and removed from the path of the bolt driver.

FIG. 24 shows a platform 1100 having a feed shell 1102 and a bolt magazine 1104. The feed shell 1102 has a cradle 1106 which slidably engages the feed shell 1102. As illustrated, a bolt driver 1108 is positioned on the cradle 1106. Other working tools can be positioned on the cradle as is taught in U.S. Pat. No. 5,114,279.

The bolt magazine 1104 has a stop plate 1110 which, when the magazine 1104 is rotated into the work position, protrudes into the path of the bolt driver 1108 as illustrated. A base stop support 1112 is attached to the platform 1100 and serves as a back stop for the stop plate 1110 reducing the load borne by the bolt magazine 1104. The base stop support 1112 is positioned such that the cradle 1106 and the tool carried thereon will pass thereby. When the bolt driver 1108 is hydraulically driven, as the bolt driver 1108 advances, it will be stopped by interference with the stop plate 1110, which in turn is stabilized by the base stop support 1112. The stop plate 1110 is positioned to remain in the path of the bolt driver 1108 until such time as the bolt magazine 1104 is cleared from the path of the bolt driver 1108, thereby eliminating damage which could result from stress induced by the bolt driver 1108 on the bolt magazine 1104 or its related elements.

Rather than providing the bolt plate stop 1110 to engage the bolt driver 1108, the bolt magazine 1104 can be used to stop the bolt driver 1108 provided that the pressure supplied to the bolt driver 1108 does not cause the bolt driver 1108 to bend the bolt magazine 1104 or its support. A limited pressure can readily be maintained by providing a limit switch that operates a pressure controller which reduces the pressure applied to advance the bolt driver 1108 until such time as the bolt magazine 1104 is raised out of the path of the bolt driver 1108. After the bolt magazine 1104 is removed from the path of the bolt driver, the pressure is allowed to rise to a level sufficient to effectively drive a bolt into a bolt hole.

Figure 26:
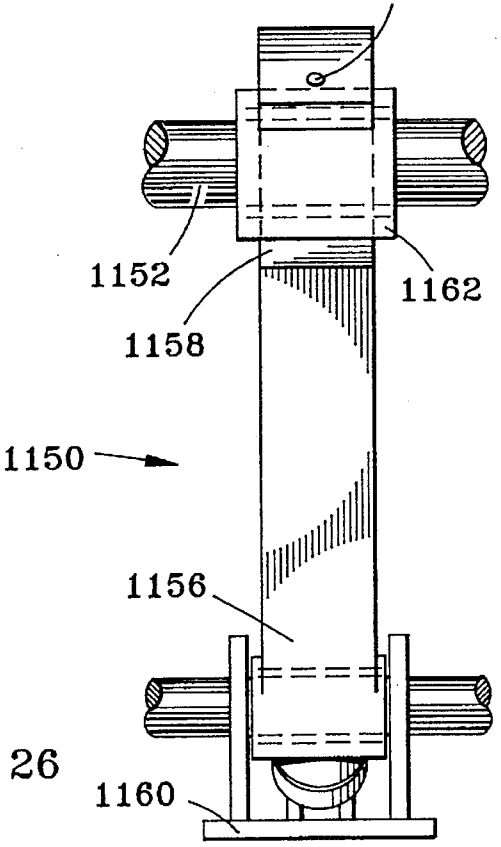
FIGS. 25 and 26 are two views of a drill steel guide that form part of the present invention. The drill steel guide offers continuous support to the drill steel.
Figure 25:
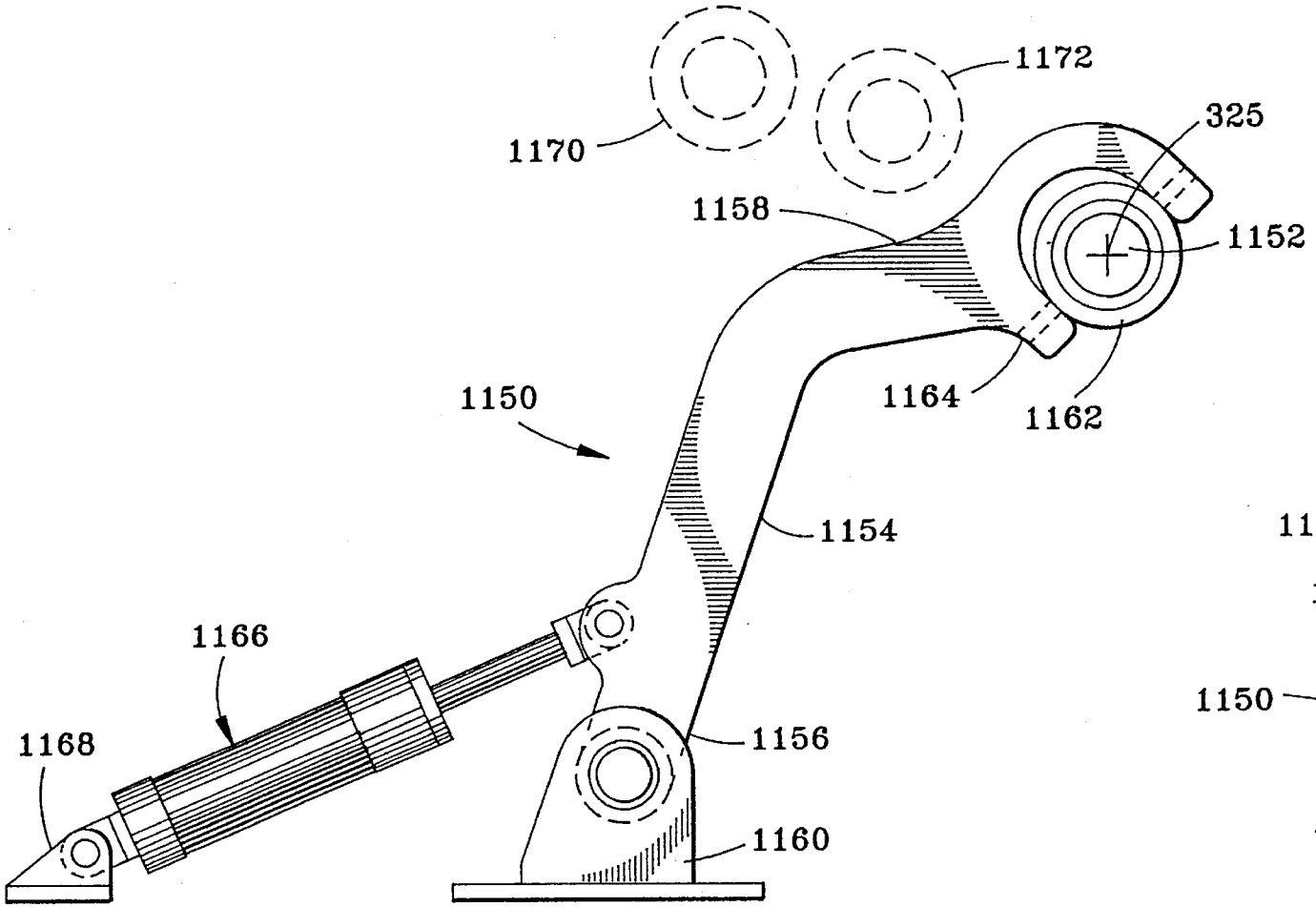

FIGS. 25 and 26 show respectively a side view and a bottom view of an improved drill steel guide 1150 for a drill steel 1152. The drill steel guide 1150 is designed so that as the drill steel 1152 is translated off the tool axis 325 (see FIG. 6), the drill steel guide 1150 will offer continued support to the drill steel 1152. The drill steel guide 1150 is also designed so that as the drill steel guide 1150 moves the drill steel 1152 away from the tool axis 325 the drill steel guide 1150 moves away from the rock surface. The drill steel guide 1150 has an arm 1154 having a first end 1156 and a second end 1158. The first end 1156 engages a bracket 1160 which attaches to the base 336 of FIG. 6. The bracket 1160 is positioned so that the arm 1154 pivots in a plane which is not normal to the feed shell 326 (shown in FIG. 6). This motion results in the arm 1154 moving away from the rock surface being drilled thereby minimizing the likelihood of damage from impact. In order to avoid a torsional force on a drill steel passing through the drill steel guide 1150, the second end 1158 of the arm 1154 is fitted with a sleeve 1162 mounted on an axis 1164 through which the drill steel 1152 passes.

The drill steel guide 1150 is positioned with a hydraulic cylinder 1166 which is pivotally connected to the drill steel guide 1150. The hydraulic cylinder 1166 is also pivotally attached to a cylinder bracket 1168 which in turn is attached to the base 336 on which the stinger/centralizer 300 is mounted (see FIG. 6). The hydraulic cylinder 1166 is provided to move the drill steel guide 1150 so that the drill steel guide 1150 provides support to the drill steel 1152 not only when the drill steel 1152 is aligned with the tool axis 325 but also to provide support to the drill steel 1152 when the drill steel 1152 is stored off the feedshell 326. When the only operations being performed are rock drilling and bolt setting, the drill steel 1152 will have a single storage position 1170. In this case, the hydraulic cylinder will direct the drill steel guide 1150 between its drilling position and its storage position. When an intermediate operation of resin injection is required, the hydraulic cylinder 1166 will be a two stage hydraulic cylinder so that a second rest position 1172 can be maintained for the drill steel 1152.

While the novel features of the present invention have been described in terms of particular embodiments and preferred applications, it should be appreciated by one skilled in the art that substitution of materials and details obviously can be made without departing from the spirit of the invention.

What we claim is:

1. A stinger/centralizer for a rock bolter having a feed shell with a feed shell axis comprising:

a stinger base affixed with respect to the feed shell;

a first head element having a first head rock engaging surface and a first head cavity therein;

a first head arm attached to said first head element, said first head arm movably engaged with said stinger base;

a second head element having a second head rock engaging surface and a second head cavity therein;

a second head arm attached to said second head element, said second head arm movably engaged with said stinger base; and means for engaging said first head element with said second head element such that said first head cavity and said second head cavity provide a centralizer passage which is substantially parallel to the feed shell axis.

2. The stinger/centralizer of claim 1 further comprising;

a first bracket forming part of said stinger base, said first head arm slidably engaging said first bracket;

a second bracket forming part of said stinger base, said second head arm slidably engaging said second bracket; and further wherein said means for engaging said first head element with said second head element further comprises:

means for translating said first head arm with respect to said second head arm.

3. The stinger/centralizer of claim 2 wherein said means for translating said first head arm with respect to said second head arm further comprises:

a linear actuator attached to said first head arm and said second head arm.

4. The stinger/centralizer of claim 2 wherein said first head arm and said second head arm are positioned such that said first head arm and said second head arm have a component of their motion parallel to the feed shell axis.

5. The stinger/centralizer of claim 4 wherein said first head element has a rock engaging surface extender.

6. The stinger/centralizer of claim 5 further comprising:

a first flexible joint between said second head element and said second head arm.

7. The stinger/centralizer of claim 6 wherein said means for translating said first head arm with respect to said second head arm further comprises:

a first linear actuator attached to said first head arm; and a second linear actuator attached to said second head arm.

8. The stinger/centralizer of claim 7 wherein said first linear actuator and said second linear actuator are hydraulic cylinders.

9. The stinger/centralizer of claim 8 further comprising:

means for indexing said first head element with said second head element assuring registry is maintained when said first head element is engaged with said second head element.

10. The stinger/centralizer of claim 9 further comprising:

a second flexible joint between said first head element and said first head arm.

11. The stinger/centralizer of claim 10 wherein means for disabling said second flexible joint is provided.

12. The stinger/centralizer of claim 6 wherein said first head element and said second head element have beveled back surfaces.

13. The stinger/centralizer of claim 4 further comprising:

a first flexible joint between said second head element and said second head arm.

14. The stinger/centralizer of claim 1 further comprising:

a first bracket forming part of said stinger base, said first bracket pivotably engaging said first head arm;

a second bracket forming part of said stinger base, said second bracket pivotably engaging said second head arm; and further wherein said means for engaging said first head element with said second head element further comprises:

means for pivoting said first head arm with respect to said second head arm.

15. The stinger/centralizer of claim 14 wherein said first bracket and said second bracket further comprise:

a first pivot post attaching to said first head arm and rotatably engaging to said first bracket;

a first torque arm attached to said first pivot post;

a second pivot post attaching to said second head arm and rotatably engaging to said second bracket;

a second torque arm attached to said second pivot post; and further wherein said means for pivoting said first head arm with respect to said second head arm further comprises:

a linear actuator pivotably attached to said first torque arm and said second torque arm.

16. The stinger/centralizer of claim 15 wherein said first head arm and said second head arm cross.

* * * * *